US010162292B2

(12) United States Patent
Mogi

(10) Patent No.: US 10,162,292 B2
(45) Date of Patent: Dec. 25, 2018

(54) IMAGE FORMING APPARATUS THAT CONTROLS A SHEET FEEDING INTERVAL BASED ON AN ABNORMAL STATE IN WHICH A HEAT ABSORPTION MEMBER REMAINS IN CONTACT WITH A PRESSING MEMBER

(71) Applicant: CANON KABUSHIKI KAISHA, Tokyo (JP)

(72) Inventor: Keisuke Mogi, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/646,549

(22) Filed: Jul. 11, 2017

(65) Prior Publication Data

US 2018/0017909 A1 Jan. 18, 2018

(30) Foreign Application Priority Data

Jul. 12, 2016 (JP) ..... 2016-137369

(51) Int. Cl.
*G03G 15/20* (2006.01)

(52) U.S. Cl.
CPC ..... *G03G 15/2042* (2013.01); *G03G 15/205* (2013.01); *G03G 15/2025* (2013.01); *G03G 15/2028* (2013.01); *G03G 2215/00603* (2013.01); *G03G 2215/00772* (2013.01)

(58) Field of Classification Search
CPC ..... G03G 15/2042; G03G 15/2025; G03G 15/205; G03G 15/2028; G03G 2215/00606; G03G 2215/00772
See application file for complete search history.

(56) References Cited

U.S. PATENT DOCUMENTS 4,063,530 A * 12/1977 Thettu ..... G03G 13/20 118/202
4,079,227 A * 3/1978 Takiguchi ..... G03G 15/2039 219/216
5,737,679 A * 4/1998 Uehara ..... G03G 15/206 399/329
6,047,158 A * 4/2000 Morigami ..... G03G 15/2042 219/216

(Continued)

FOREIGN PATENT DOCUMENTS

JP 2014-52452 A 3/2014

*Primary Examiner* — G. M. Hyder
(74) *Attorney, Agent, or Firm* — Fitzpatrick, Cella, Harper & Scinto

(57) ABSTRACT

An image forming apparatus includes an image forming station for forming a toner image on a sheet; a heating member and a pressing roller that form a nip for fixing the toner image on a sheet; a heat absorption roller for absorbing heat by contacting the pressing roller; a moving mechanism for moving the heat absorption roller to and away from the pressing roller; a detector for detecting an abnormal state that heat absorption roller remains contacted the pressing roller; and a controller for controlling an interval between adjacent sheets when image forming operation is continuously carried out for a plurality of sheets, wherein when the detector does not detect the abnormal state, the controller supplies the sheets at a first feeding interval, and, when the detector detects the abnormal state, the controller supplies of the sheets at a second feeding interval longer than the first interval.

8 Claims, 14 Drawing Sheets

(56) References Cited

U.S. PATENT DOCUMENTS

| | | | | |
|---|---|---|---|---|
| 6,282,399 | B1 * | 8/2001 | Tokimatsu | G03G 15/2053 399/330 |
| 9,632,463 | B2 * | 4/2017 | Yagi | G03G 15/2017 |
| 2003/0016958 | A1 * | 1/2003 | Wada | G03G 15/2042 399/45 |
| 2007/0036571 | A1 * | 2/2007 | Kagawa | G03G 15/2039 399/69 |
| 2007/0166084 | A1 * | 7/2007 | Yoshino | G03G 15/2042 399/329 |
| 2009/0314478 | A1 * | 12/2009 | Yamada | B21D 53/06 165/133 |
| 2010/0278569 | A1 * | 11/2010 | Finn | G03G 15/2064 399/329 |
| 2011/0229230 | A1 * | 9/2011 | Urano | G03G 15/2057 399/333 |
| 2013/0058673 | A1 * | 3/2013 | Kikkawa | G03G 15/2042 399/69 |
| 2013/0188978 | A1 * | 7/2013 | Takeuchi | G03G 15/2042 399/69 |
| 2014/0064754 | A1 * | 3/2014 | Hara | G03G 15/2039 399/43 |
| 2014/0105658 | A1 * | 4/2014 | Tamaki | G03G 15/2032 399/329 |

* cited by examiner

IMAGE FORMING APPARATUS THAT CONTROLS A SHEET FEEDING INTERVAL BASED ON AN ABNORMAL STATE IN WHICH A HEAT ABSORPTION MEMBER REMAINS IN CONTACT WITH A PRESSING MEMBER

This application claims the benefit of Japanese Patent Application No. 2016-137369 filed on Jul. 12, 2016, which is hereby incorporated by reference in its entirety.

FIELD OF THE INVENTION AND RELATED ART

The present invention relates to an image forming apparatus that forms a toner image on a sheet of recording medium. As examples of this type of image forming apparatus, an electrophotographic copying machine, an electrophotographic printing machine, an electrophotographic facsimile machine, and an electrophotographic multifunction machine that is capable of functioning as two or more of the preceding machines, can be listed.

An electrophotographic image forming apparatus forms a toner image on recording medium (also referred to as "recording paper") through each of charging, exposing, developing, transferring, and fixing processes. As a fixing apparatus, there has been known such a fixing apparatus that employs a fixation belt that is high in thermal conductivity, being therefore known as a fixing apparatus of the so-called on-demand type, and that is relatively short in the length of time it takes for the apparatus to start up.

Although this type of fixing apparatus that employs a fixation belt enjoys a merit that it is relatively short in the length of start-up time, it suffers from the problem in that, if the fixing apparatus is continuously used for a fixation process for a substantial number of narrow sheets of recording paper, the portions of the belt that are outside the sheet path excessively increase in temperature.

Thus, the fixing apparatus disclosed in Japanese Laid-open Patent Application No. 2014-52452 is provided with a hollow aluminum roller (rotational heat absorbing member) that is for making a fixing belt uniform in temperature in terms of the direction perpendicular to the recording paper conveyance direction. To describe in greater detail, a heat distribution roller is placed in contact with a pressure roller to ease the pressure roller in the nonuniformity in temperature in terms of its lengthwise direction (condition that portions of pressure roller that are out of recording paper path are extremely high in temperature compared to a portion of pressure roller that is within the recording paper path).

Further, during the initial period of an image forming operation, this heat distribution roller is kept away from the pressure roller to prevent the heat distribution roller from increasing the fixing apparatus in the length of startup time.

In the past, however, an image forming apparatus was structured so that, if the mechanism for placing the heat distribution roller in contact with, or separating the heat distribution roller from, the pressure roller breaks down, the image forming apparatus cannot form images until the fixing device is repaired. Thus, there is a lot to be improved regarding the structure of an image forming apparatus that employs a heat distribution roller.

SUMMARY OF THE INVENTION

According to one aspect, the present invention provides an image forming apparatus comprising an image forming station configured to form a toner image on a recording material, a rotatable heating member and a rotatable pressing member that are configured to form a nip for fixing the toner image on the recording material, a rotatable heat absorption member configured to absorb heat by contacting the rotatable pressing member, a moving mechanism configured to move the rotatable heat absorption member to and away from the rotatable pressing member, a detecting portion configured to detect an abnormal state in which the rotatable heat absorption member remains in contact with the rotatable pressing member, and a controller configured to control an interval between adjacent recording materials when an image forming operation is continuously carried out for a plurality of recording materials, wherein, when the detecting portion does not detect the abnormal state, the controller supplies the recording materials into the nip at a first feeding interval, and, when the detecting portion detects the abnormal state, the controller supplies the recording materials into the nip at a second feeding interval that is longer than the first interval.

According to another aspect, the present invention provides an image forming apparatus comprising an image forming station configured to form a toner image on a recording material, a rotatable heating member and a rotatable pressing member that are configured to form a nip for fixing the toner image on the recording material, a rotatable heat absorption member configured to absorb heat by contacting the rotatable pressing member, a moving mechanism configured to move the rotatable heat absorption member to and away from the rotatable pressing member, a detecting portion configured to detect an abnormal state in which the rotatable heat absorption member is unable to contact the rotatable pressing member and remains spaced from the rotatable pressing member, and a controller configured to control an interval between adjacent recording materials when an image forming operation is continuously carried out for a plurality of predetermined recording materials having widths that are less than a maximum width that is usable with the image forming apparatus, wherein, when the detecting portion detects the abnormal state, the controller supplies the recording materials into the nip at a first feeding interval, for a predetermined period, and thereafter, the controller supplies the recording material into the nip at a second feeding interval that is longer than the first interval.

Further features of the present invention will become apparent from the following description of exemplary embodiments with reference to the attached drawings.

Figure 5:
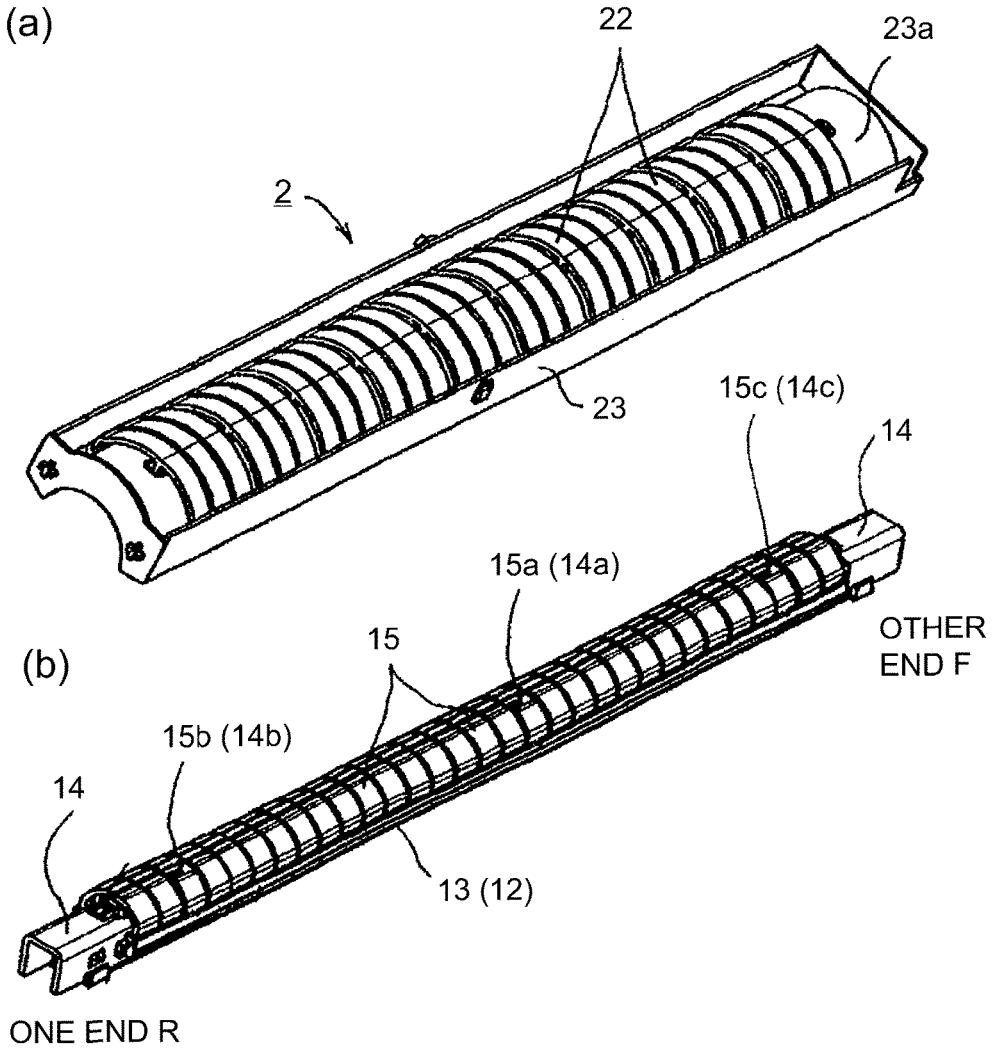

Part (a) of FIG. 5 is a schematic perspective view of the coil unit of the fixing apparatus, and part (b) of FIG. 5 is a schematic perspective view of the internal assembly of the belt unit of the fixing apparatus.

Figure 6:
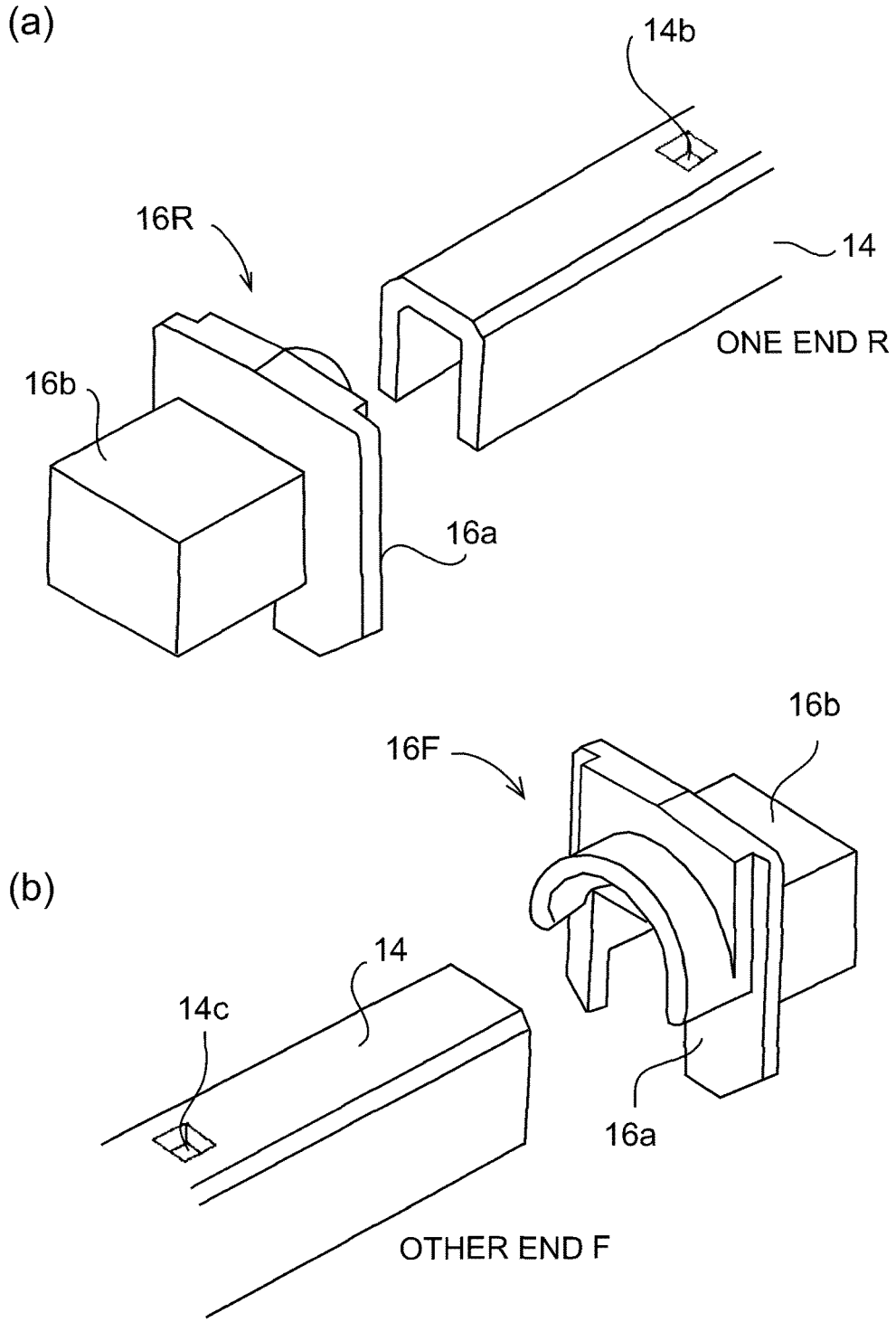

Part (a) of FIG. 6 is a schematic perspective view of one of the lengthwise end portions of a disassembled combination of the flange of the fixing apparatus, and the stay that is to be fitted with the flange, and part (b) of FIG. 6 is a schematic perspective view of the other lengthwise end portion of the disassembled combination.

Figure 7:
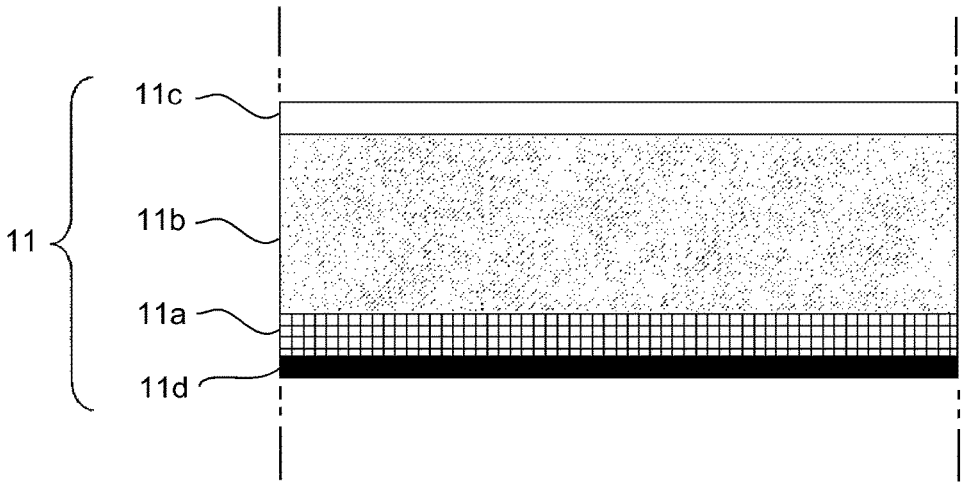

FIG. 7 is a schematic sectional view of the fixation belt, and is used for showing the laminar structure of the belt.

Figure 8:
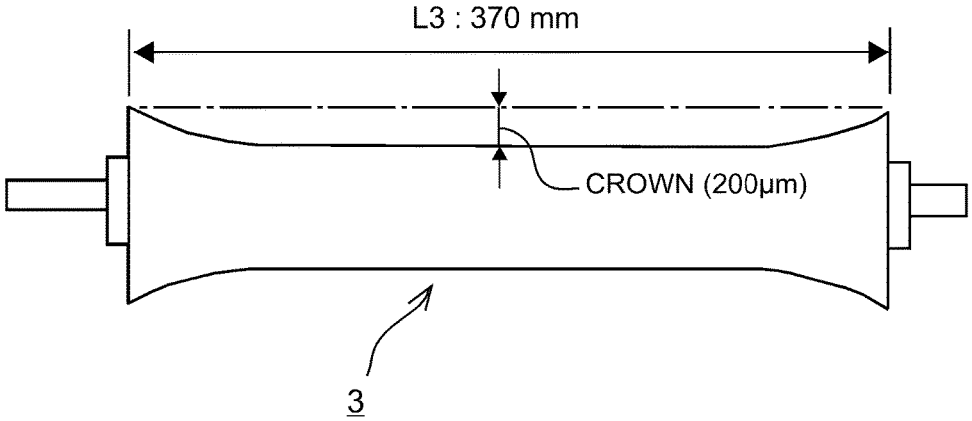

FIG. 8 is a front view of the pressure roller, and is used for describing an amount of convex.

Figure 9:
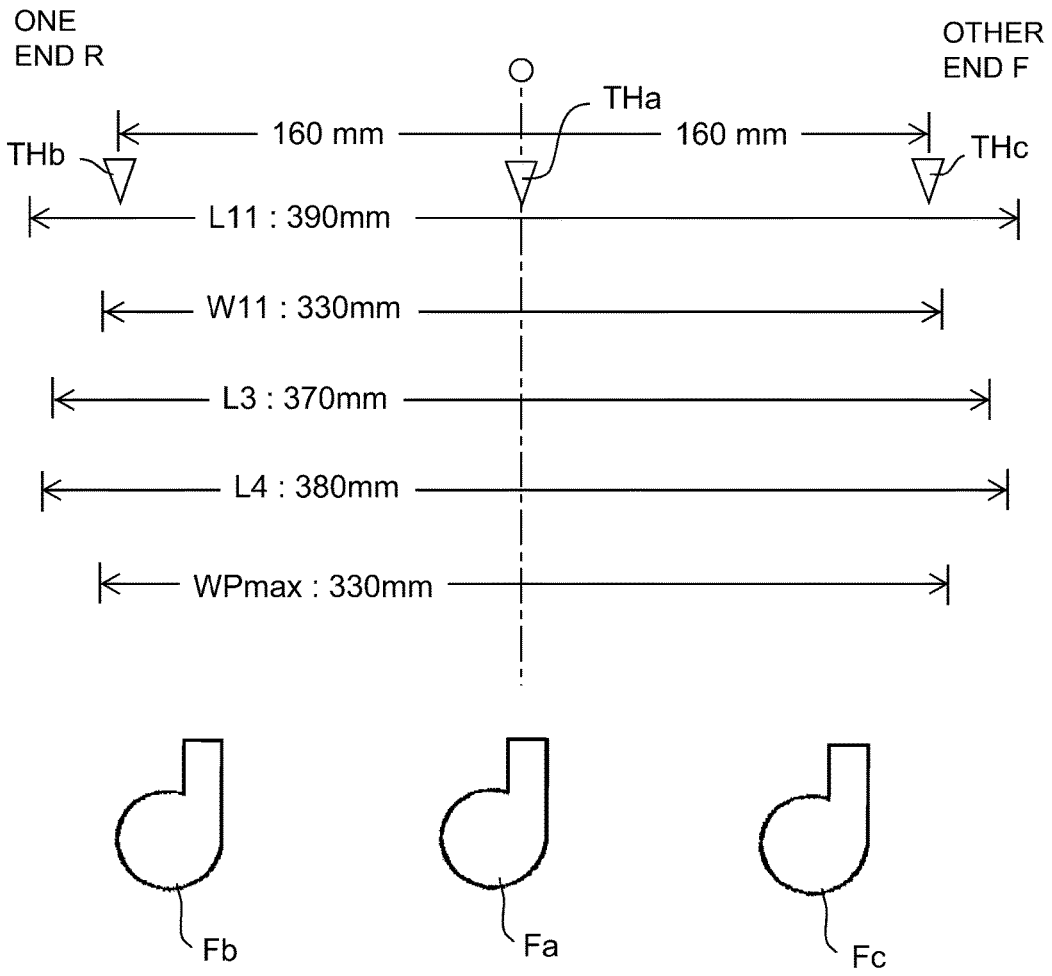

FIG. 9 is a drawing for showing the length of each of the essential structural members of the fixing apparatus, and the positioning of temperature sensors relative to the essential structural members.

Figure 10:
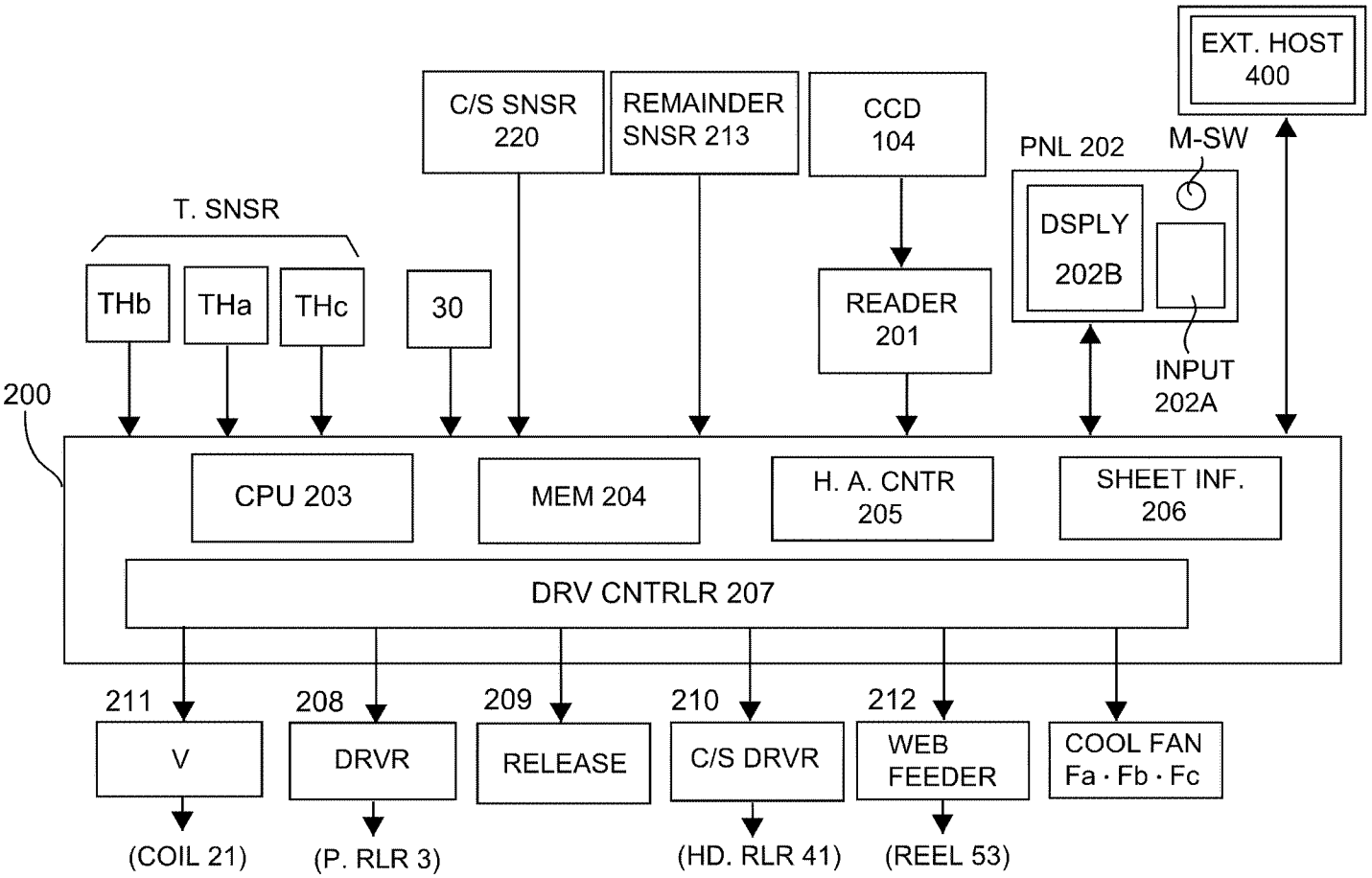

FIG. 10 is a block diagram of the control system of the image forming apparatus.

Figure 11:
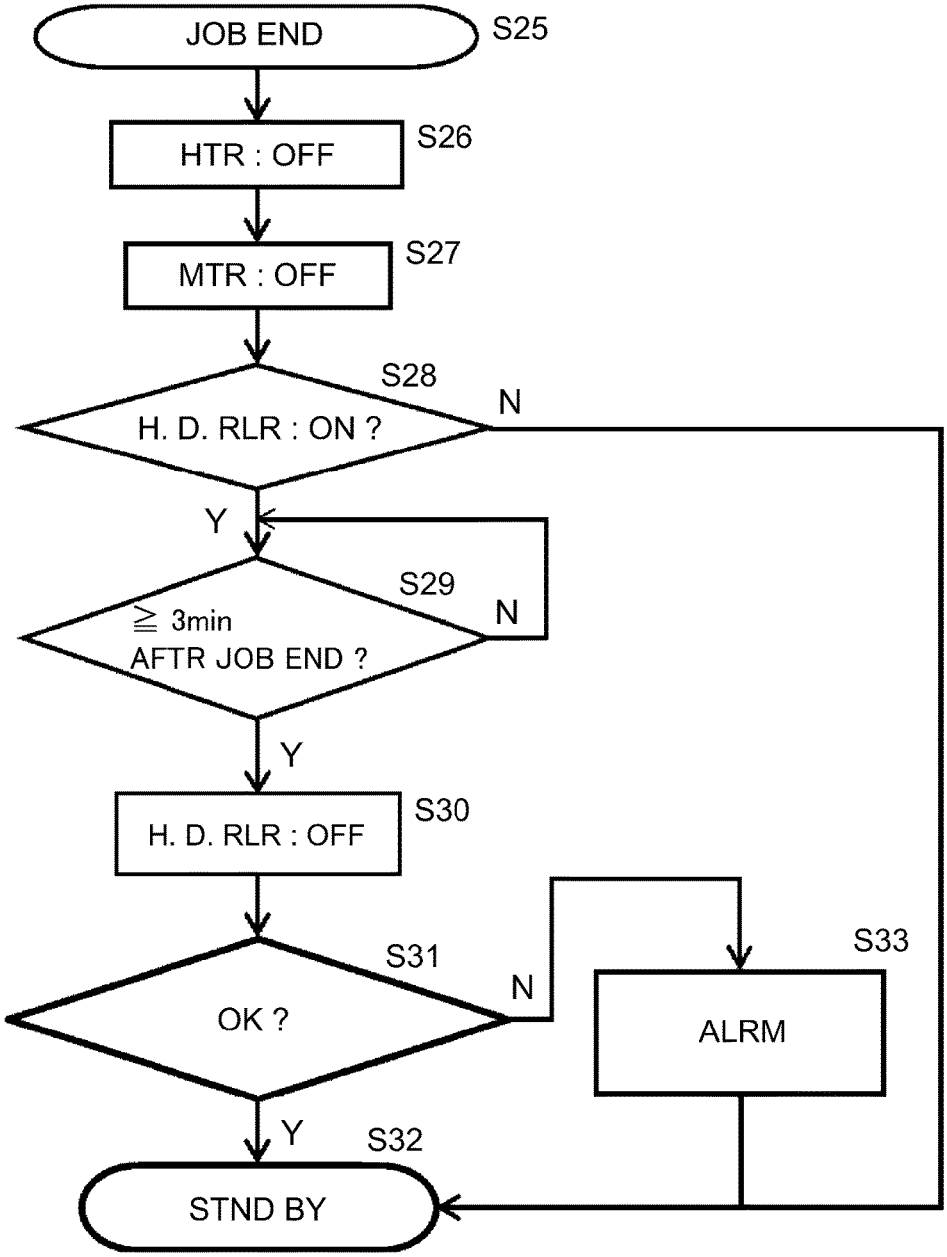

FIG. 11 is a flowchart of the control sequence of the image forming apparatus in the second embodiment of the present invention (No. 1).

Figure 12:
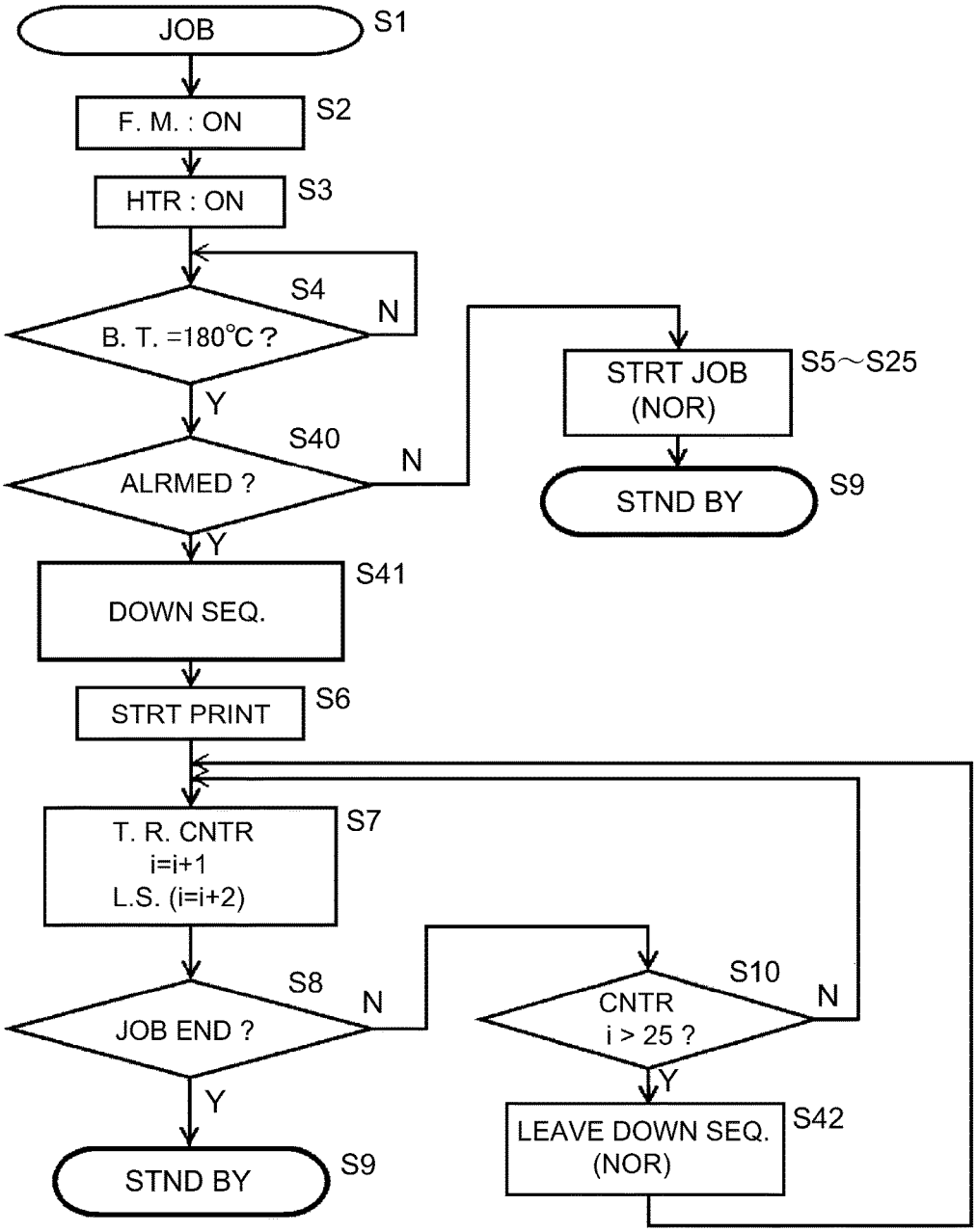

FIG. 12 is a flowchart of the control sequence of the image forming apparatus in the second embodiment (No. 2).

Figure 13:
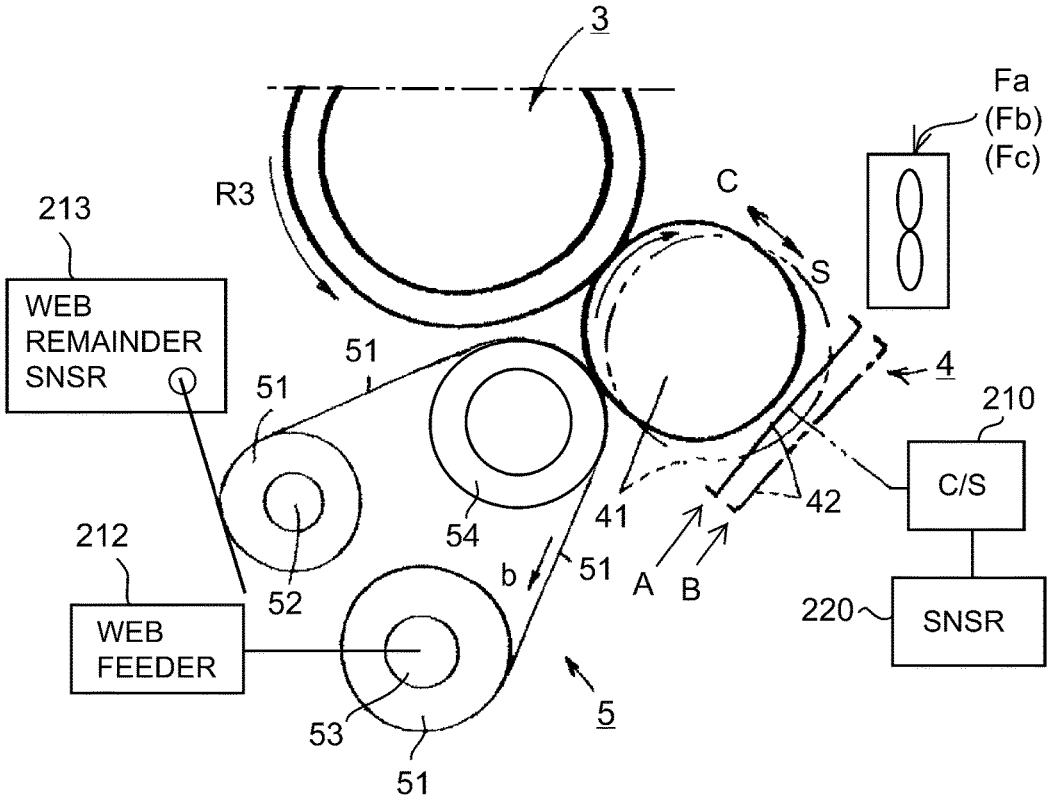

FIG. 13 is a cross-sectional view of the essential portion of each of the fixing apparatuses in the third and fourth embodiments of the present invention, and is used for describing the structure of the fixing apparatus.

Figure 14:
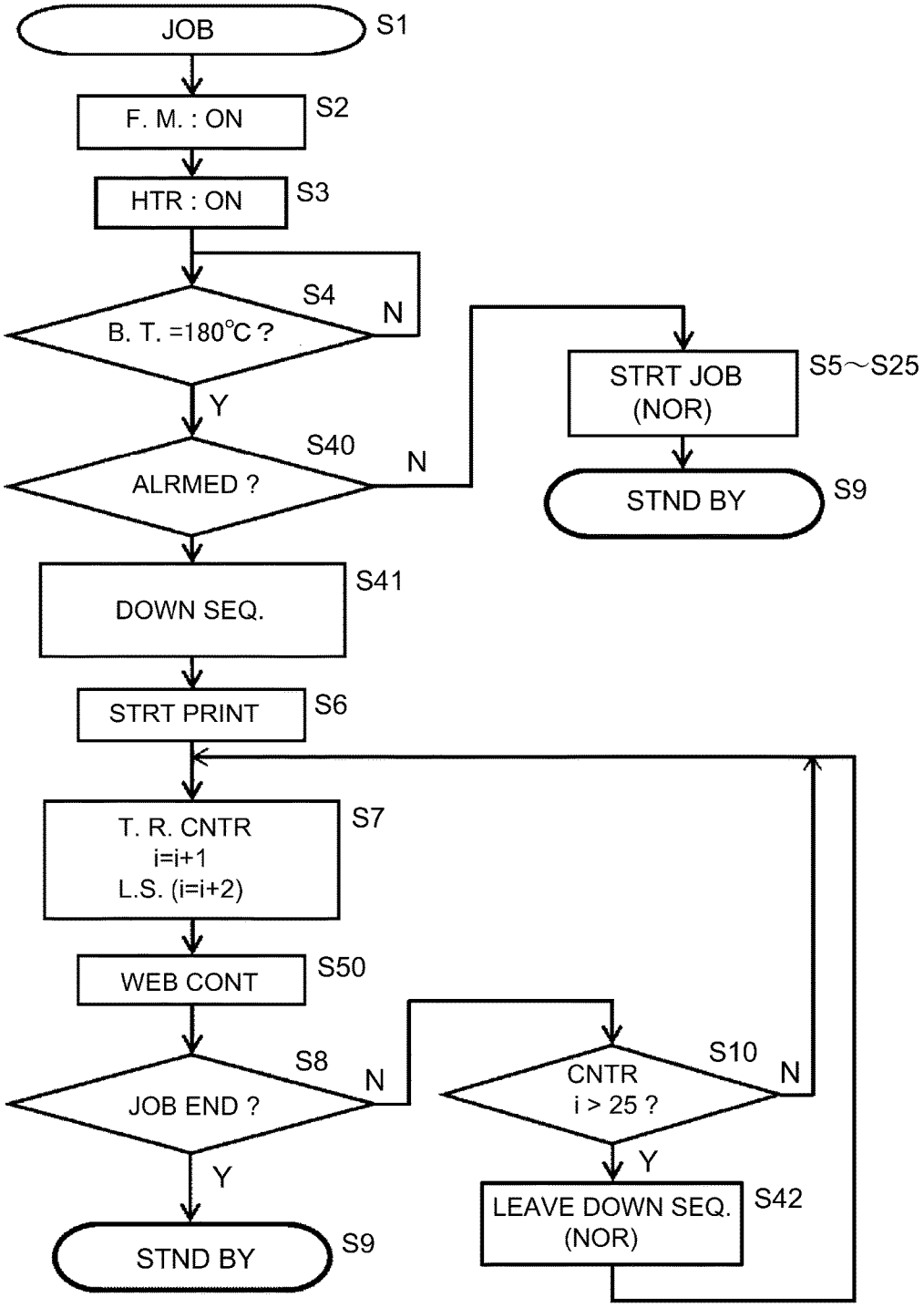

FIG. 14 is a flowchart of the control sequence of the image forming apparatus in the third embodiment.

Figure 15:
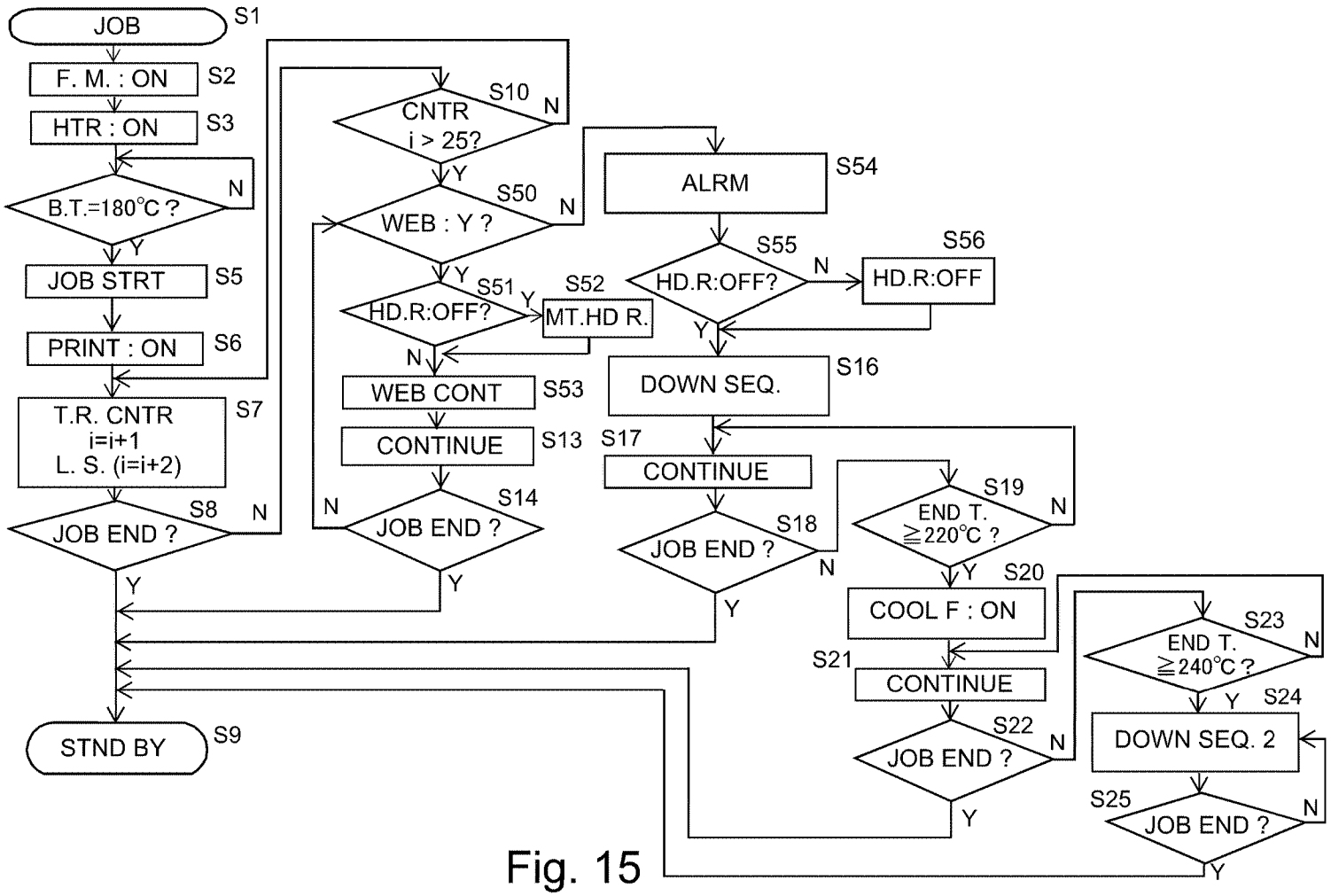

FIG. 15 is a flowchart of the control sequence of the image forming apparatus in the fourth embodiment.

DESCRIPTION OF THE EMBODIMENTS

Embodiment 1

[Image Forming Apparatus]

Figure 2:
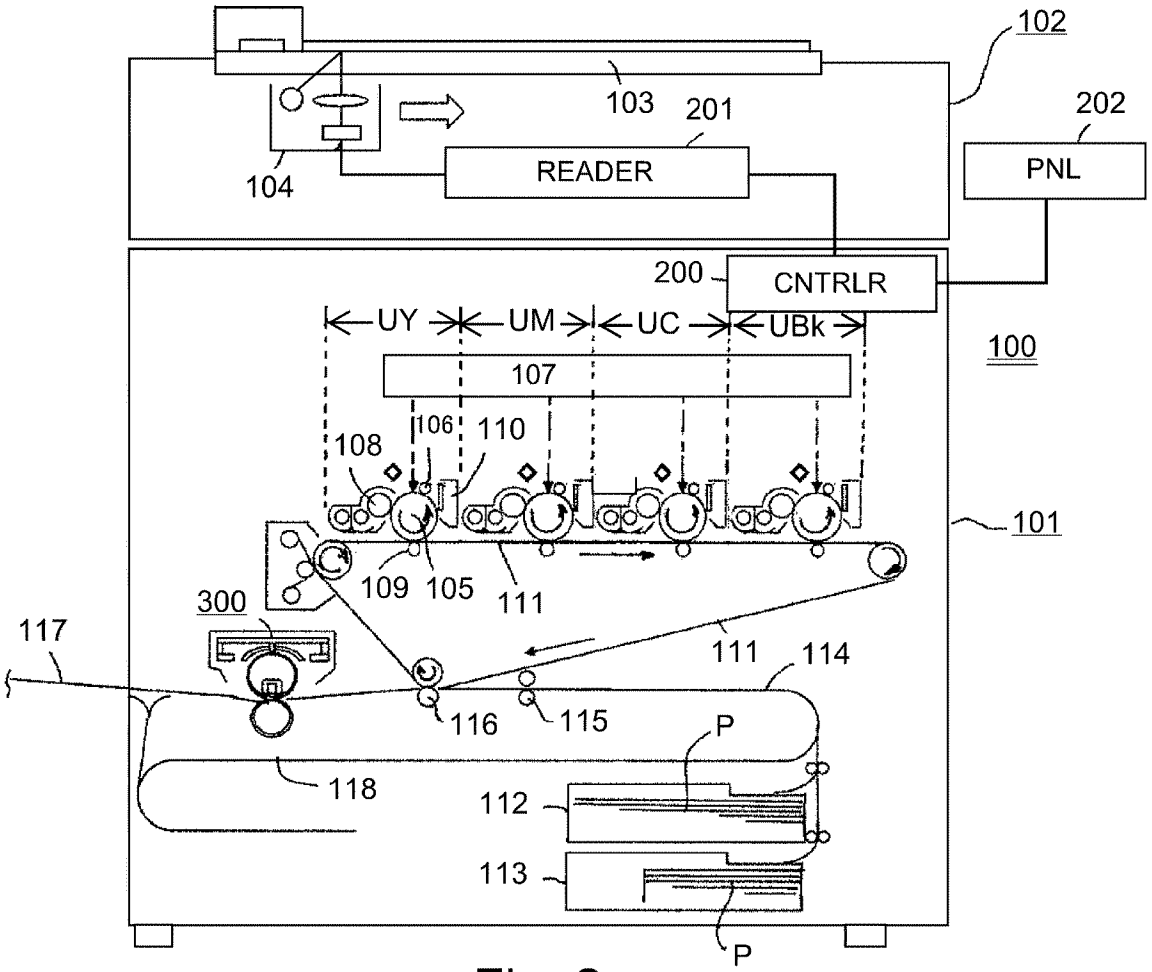
FIG. 2 is a schematic sectional view of the image forming apparatus in the first embodiment.

FIG. 2 is a schematic sectional view of the image forming apparatus 100 in the first embodiment, and shows the structure of the apparatus. The image forming apparatus 100 has an apparatus main assembly 101, and a reading portion 102 placed on top of the main assembly 101. It is an electrophotographic full-color image copying machine of the so-called tandem type, and also, of the so-called intermediary transfer type.

The reading portion 102 has an original placement glass platen 103, and a CCD sensor unit 104 that photoelectrically reads the original on the glass platen 103 by scanning the original. The image formation signals obtained by the CCD sensor unit 104 are sent from a processing portion 201 of the reading portion 102 to a printer control portion 200, in which they are processed in a manner to accommodate the image forming portion of the apparatus main assembly 101. Various information is also inputted to the control portion 200 through a control panel 202.

The apparatus main assembly 101 has four image forming portions UY, UM, UC, and UBk that form yellow (Y), magenta (M), cyan (C), and black (Bk) toner images, respectively. Each image forming portion UY, YM, UC, and UBk has a photosensitive drum 105, a charging device 106, a laser scanner 107, a developing device 108, a primary transfer roller 109, and a drum cleaner 110. By the way, in order to prevent the image forming apparatus 100 from appearing excessively complicated, the referential codes for the image forming portions UM, UC, and UBk, that is, image forming portions other than the image forming portion UY, are not shown in FIG. 2. Further, the electrophotographic process and the other image formation steps of these image forming portions are widely known, and, therefore, they are not described.

Four toner images, different in color, are sequentially transferred from the photosensitive drums 105 onto a rotationally moving intermediary transfer belt 111 in such a manner that they are layered on the intermediary transfer belt 111 (primary transfer). Consequently, four toner images, different in color, are layered on the intermediary transfer belt 111. Meanwhile, sheets P of recording medium (also referred to simply as recording paper or paper) are fed, one by one, from a cassette 112 or 113, into the apparatus main assembly 101. Then, each sheet P of recording paper is conveyed through a recording medium conveyance passage 114, and then, is introduced by a pair of registration rollers 115 into the secondary transfer nip that is an area in which the belt 111 and secondary transfer roller are kept pressed upon each other, with preset control timing. While the sheet P is conveyed through the secondary transfer nip, the layered four toner images on the belt 111 that are different in color are transferred together onto the sheet P (secondary transfer).

Then, the sheet P of recording paper is introduced into a fixing apparatus 300 (fixing portion), as an image heating apparatus, and is conveyed through the fixing apparatus 300, while being heated and pressed. Thus, the unfixed toner images become melted/softened, and become fixed to the sheet P (thermal fixation: image heating process). In a case in which an image formation job is to be carried out in the one-sided mode, the sheet P is discharged onto a delivery tray 117 after the unfixed toner images on the first surface of the sheet P are fixed, and the sheet P comes out of the fixing apparatus 300.

On the other hand, in a case in which the job requires that the image formation job is to be carried out in the two-side mode, the sheet P having a fixed image on one of its two surfaces is conveyed through a sheet turning conveyance passage 118 to be turned over, and then, is introduced into the secondary transfer nip, for the second time, through a conveyance passage 114, after it is conveyed through the fixing apparatus 300 for the first time. Consequently, a second set of toner images is transferred onto the second surface of the sheet P. Then, the sheet P is conveyed through the fixing apparatus 300 for the second time. Then, the sheet P having a fixed image on both surfaces is discharged onto the delivery tray 117.

By the way, the image forming apparatus 100 in this embodiment is structured so that, when a sheet P of recording paper is conveyed through the image forming apparatus 100, its center in terms of its widthwise direction coincides with the center of the recording medium passage of the apparatus main assembly 101, regardless of its size.

[Fixing Apparatus]

Regarding the positioning (attitude) of the fixing apparatus 300, described next, the front side of the fixing apparatus 300 is the side of the image forming apparatus that faces an observer when the fixing apparatus 300 is observed from the sheet entrance side of the fixing apparatus 300. The rear side of the fixing apparatus 300 is the opposite side (recording medium outlet side) of the fixing apparatus 300 from the front side of the image forming apparatus 100. The left and right sides of the fixing apparatus 300 are the left and right sides of the image forming apparatus 100 when the image forming apparatus 100 is observed from the front side of the fixing apparatus 300. Further, in this embodiment, the right and left sides of the image forming apparatus 300 are referred to as the sides R and F, respectively. The top and bottom mean top and bottom with reference to the gravity direction. The upstream and downstream sides mean the upstream and downstream with reference to the recording paper conveyance direction (recording medium conveyance direction). Further, regarding the positioning (attitude) of the fixing apparatus 300 and that of the members of which the fixing apparatus 300 is made up, the lengthwise direction (widthwise direction) means such direction that is perpendicular to the recording paper conveyance direction, in the recording paper conveyance plane (passage). The widthwise direction is such direction that is parallel to the recording paper conveyance direction.

Figure 3:
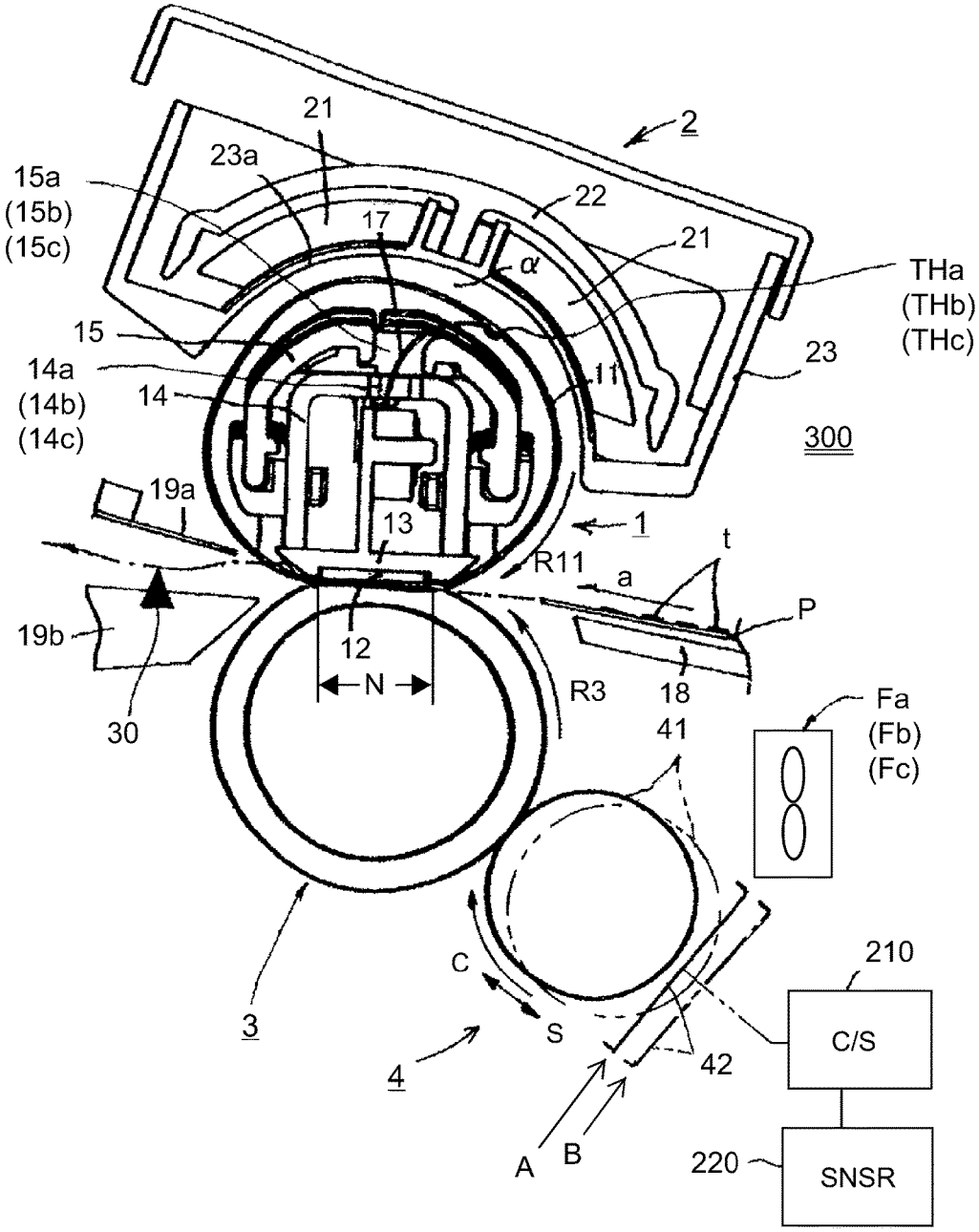
FIG. 3 is a schematic cross-sectional view of the essential portion of the fixing apparatus in the first embodiment, as seen from the right side of the apparatus.
Figure 4:
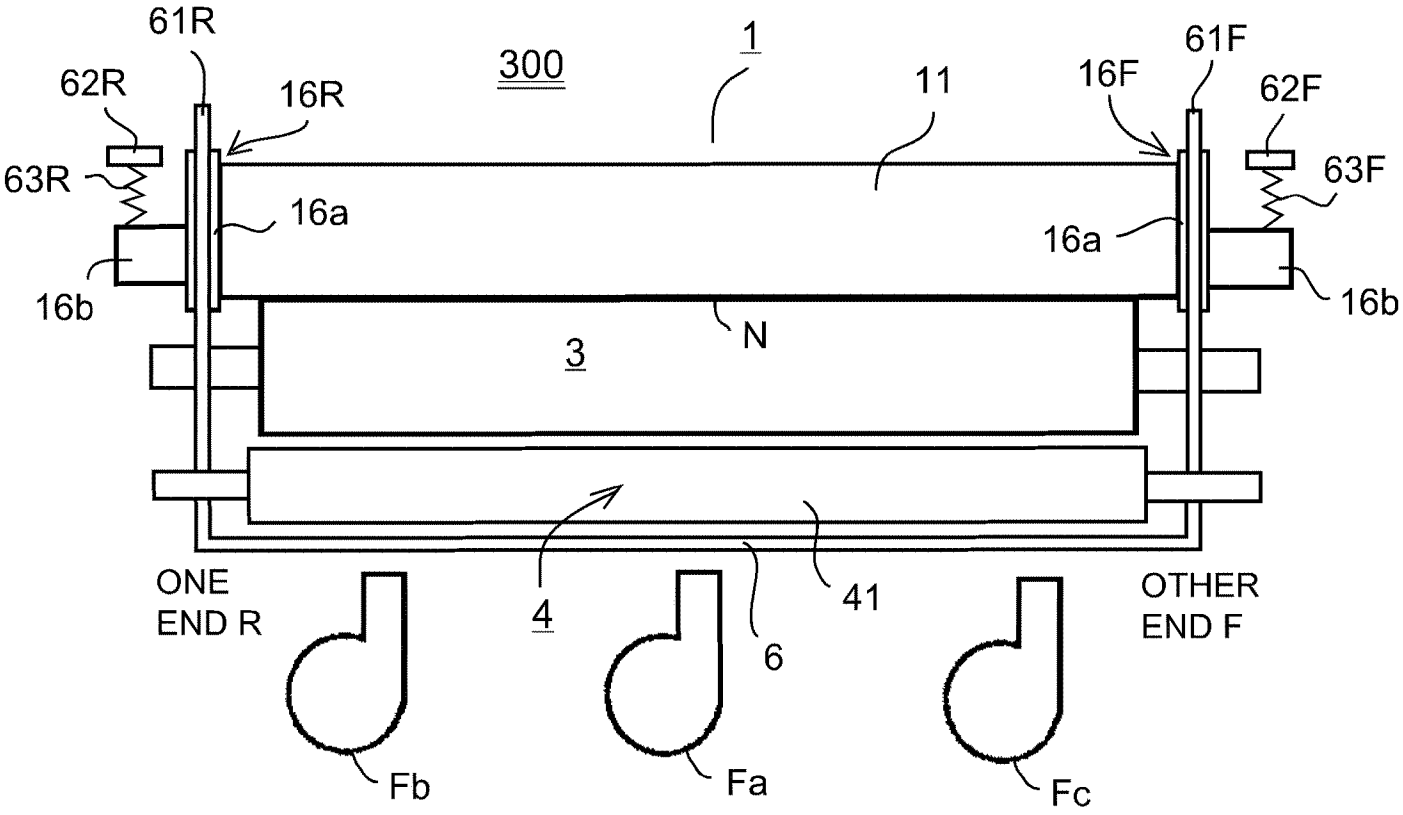
FIG. 4 is a schematic front view of the essential portion of the fixing apparatus, as seen from the front side of the apparatus.

FIG. 3 is a schematic cross-sectional view of the essential portion of the fixing apparatus 300, as seen from the right side of the fixing apparatus 300. FIG. 4 is a schematic front view of the essential portion of the fixing apparatus 300. The fixing apparatus 300 is an image heating apparatus of the so-called induction heating type (IH type), and also, of the belt-based heating type. Roughly speaking, it has such members and systems (mechanisms) that resemble those that are described next, including a: a belt unit 1 having a flexible endless belt 11 (also referred to as fixation belt or simply as belt) as the first rotational member (rotational heating member) that heats a toner image t formed on a sheet P of recording paper, in the nip N, b: a coil unit 2 (inductive heating apparatus, magnetic flux generating means) as a heating device (heating means) for heating the belt 11, c: an elastic pressure roller 3 as the second rotational member (rotational pressing member) that forms the nip N between itself and the belt 11, d: a heat distribution unit 4 having a heat absorbing rotational member 41 (also referred to as heat distribution roller) as the third rotational member that absorbs heat from the pressure roller 3 by being placed in contact with the pressure roller 3, e: cooling fans Fa, Fb, and Fc (Sirocco fan) as cooling means for cooling the center portion of the pressure roller 3 in terms of its lengthwise direction (in terms of widthwise direction of fixing apparatus 300), one of the lengthwise end portions of the pressure roller 3, the other lengthwise end portion of the pressure roller 3, respectively, and f: a frame 6 (chassis, housing) that internally holds the abovementioned members and systems (mechanisms).

(1) Belt Unit 1

The belt unit 1 has an internal assembly disposed on the inward side of the loop that the belt 11, having a metallic layer that generates heat as a magnetic flux runs through it, forms. This assembly is a combination of a padding member 13 as a pressure applying member, a metallic stay 14, an internal core 15 (magnetic core), etc. The padding member 13 has a fixation pad 12. The stay 14 holds the padding member 13. The stay 14 is U-shaped in cross section, and is disposed so that its opening side faces downward. The internal core 15 covers the stay 14. Part (b) of FIG. 5 is a schematic perspective view of this internal assembly.

Each of the pad 12, padding member 13, the stay 14, and the internal core 15 is a long and narrow component, and is disposed so that its lengthwise direction is parallel to the lengthwise direction of the belt 11 (widthwise direction of fixing apparatus 300). The lengthwise end portions of the stay 14 are protrude outwardly from the belt 11 at the corresponding edges of the belt 11, and are fitted with flanges 16R and 16F, one for one (FIG. 4). Part (a) of FIG. 6 is a perspective view of a combination of one of the lengthwise end portions of the stay 14, and the flange 16R with which the lengthwise end portion of the stay 14 is fitted. Part (b) of FIG. 6 is a perspective view of a combination of the other lengthwise end portion of the stay 14, and the flange 16F with which the other lengthwise end portion of the stay 14 is fitted. The belt 11 is loosely fitted around the components 12 to 15 of the internal assembly, and between the inward surfaces 16*a* and 16*a* of the flanges 16R and 16F, respectively.

The inward side (opposite side from the pad 12) of the padding member 13 is provided with temperature sensor seats (unshown) that are at one of the lengthwise end portions, center portion, and the other lengthwise end portion, of the padding member 13. The fixing apparatus 300 is provided with three temperature sensors, more specifically, a center portion temperature sensor THa, an end portion temperature sensor THb, and an end portion temperature sensor THc, that are attached to the above-mentioned temperature sensor mounts, one for one, with the placement of an elastic supporting member 17 between each temperature sensor and the corresponding mount.

Further, the lengthwise center portion of the stay 14 and the lengthwise end portions of the stay 14 are provided with through holes 14*a*, 14*b*, and 14*c*, respectively, whereas the lengthwise center portion of the inner core 15, and the lengthwise end portions of the inner core 15, are provided with through holes 15*a*, 15*b*, and 15*c*, respectively. The temperature sensor supporting members 17 are outwardly protrusive from the inner core 15, through the through holes 14*a*, 14*b*, and 14*c* of the stay 14, and through the holes 15*a*, 15*b*, and 15*c* of the inner core 15, respectively. The aforementioned temperature sensors THa, THb, and THc are supported by the tips of the supporting members 17, one for one, in such a manner that they remain in contact with the lengthwise center portion and lengthwise end portions of the belt 11, on the inward side of the loop that the belt 11 forms.

Thus, even if the belt 11 waves, the temperature sensors THa, THb, and THc are enabled to follow the movement of the belt 11 in terms of the direction perpendicular to the rotational direction of the belt 11. Therefore, the temperature sensors THa, THb, and THc remain satisfactorily in contact with the belt 11.

Next, referring to FIG. 7, the belt 11 is described. In this embodiment, the belt 11 is 30 mm in internal diameter, and 390 mm in length. The belt has a substrative layer 11*a* that generates heat as magnetic fluxes moves through the substrative layer 11*a*, and is made with the use of an electrical casting method. The thickness of the substrative layer 11*a* is 40 μm. The length L (width) of the belt 11 (FIG. 9) corresponds to the length of this substrative layer 11*a*, and is 390 mm.

The outward surface of the substrative layer 11*a* is covered with a heat resistant silicone rubber layer 11*b* (also referred to as an elastic layer), the thickness of which is desired to be set to a value in a range of 100 μm to 1000 μm. In this embodiment, in consideration of an object to reduce the belt 11 in thermal capacity to reduce the fixing apparatus 300 in the length of the time it takes to warm up the belt 11, and also, in consideration of an object of yielding a properly fixed a color image, the thickness of the silicone rubber layer 11*b* is set to 300 μm. This silicone rubber, of which the silicone rubber layer 11*b* is formed, has a hardness of 20° (JIS-A), and is 0.8 W/mK in thermal conductivity.

The outward surface of the elastic layer 11*b* is covered with a release layer 11*c* formed of fluorinated resin (PFA and PTFE, for example) that is 300 μm in thickness. In order to reduce the friction between the belt 11 and the above-described temperature sensors THa, THb, and THc, the inward surface of the substrative layer 11*a* may be covered with a resinous layer 11*d* (slippery layer) that is formed of fluorinated resin, polyimide, or the like, and the thickness of which is in a range of 10 μm to 50 μm. In this embodiment, a polyimide layer that is 20 μm in thickness is provided as the resinous layer 11*d*.

By the way, as the material for the substrative layer 11*a* of the belt 11, iron alloy, copper, silver, or the like, may be chosen in addition to nickel, as fits. Further, the substrative layer 11*a* may be formed of a combination of a resinous layer 11*d*, and a metallic layer layered upon the substrative layer 11*a*. The thickness of the substrative layer 11*a* may be adjusted according to the frequency of the high frequency electrical current that will flow to the excitation coil 21 of the coil unit 2, and the permeability-conductivity of the metallic layer. The thickness of the substrative layer 11*a* is desired to be set to a value in a range of 5 μm to 200 μm.

As the pressure roller 3 is pressed against the padding member 13 having the pad 12, with the presence of the belt 11 between the pressure roller 3 and the padding member 13, the nip N is formed. The pad 12 is formed of such a substance as stainless steel, or the like, or another metal, a ceramic, or the like, that is great in hardness. The pad 12 is a long and narrow member, and is roughly 1 mm in thickness. The pad 12 is disposed so that its long edges are parallel to the lengthwise direction. The material for the padding member 13 is a heat resistant resin, such as polyphenylene sulfide (PPS) and liquid crystal polymer (LCP).

The stay 14 that holds the padding member 13 needs to be rigid in order to provide the nip N with a preset amount of internal pressure. Thus, the stay 14 is rigid, and is formed of a metallic substance. Since it is desired that it is only the belt 11 that is made to generate heat by the coil unit 2, the material for the stay 14 is desired to be a nonmagnetic substance, such as stainless steel, as this material is unlikely to be affected by induction heating.

In order to improve the fixing apparatus 300 in the level of effectiveness with which the belt 11 is inductively heated, the fixing apparatus 300 is provided with the inner core 15 that is disposed on the coil unit side of the stay 14. Referring to part (b) of FIG. 5, the inner core 15 is made up of multiple sections that are aligned in the lengthwise direction of the inner core 15 in such a manner that the distance between the coil unit 2 and an excitation coil 21 (described later) gradually changes toward the lengthwise edges (or center). In order to ensure that the magnetic flux, generated by causing high frequency current to flow through the coil 21, is effectively used to heat the belt 11, the inner core 15 is formed of ferrite, or a similar material that is high in magnetic permeability, and therefore, it is effective to block magnetic flux.

Regarding the attachment of the belt unit 1 to the apparatus main assembly 101 of the image forming apparatus 100, each of two lateral plates (walls) 61R and 61F of the apparatus frame 6 is provided with a vertical slit (unshown). Thus, the belt unit 1 is held to the apparatus frame 6 by fitting the flange portions 16R and 16F into the corresponding vertical slits of the lateral walls, one for one. Thus, the entirety of the belt unit 1 is allowed to vertically move within a preset range, between the lateral plates 61R and 61F, and the belt unit 1 is afforded a certain amount of latitude in terms of the vertical movement.

(2) Pressure Roller

The pressure roller 3 in this embodiment is an elastic roller that is 30 mm in external diameter. The pressure roller 3 is made up of a metallic core, and an elastic layer formed on the peripheral surface of the metallic core. The metallic core is 20 mm in the diameter of its center portion, and 19 mm in the diameter of its lengthwise end portions. The elastic layer is a silicone rubber layer, and has a length of 370 mm. The "length L3 (width)" of the pressure roller 3 means the length of the elastic layer (FIG. 9). The outward surface of the elastic layer is covered with a release layer that is formed of fluorinated resin (perfluoroalkpxy alkane (PFA) and polytetrafluoroethylene (PTFE), for example), and that is 30 μm in thickness. The hardness of the lengthwise center portion of the pressure roller 3 is 70° in ASK-C.

Referring to FIG. 8, the pressure roller 3 is shaped so that its lengthwise end portions are greater in external diameter than its center portion, and is shaped so that it appears inversely crowned in front (or rear) view (that is exaggerated in the amount of inverse crowning). The amount of inverse crowning is such that the difference in radius between the lengthwise center portion and the lengthwise end portions is 200 μm. By the way, the pressure roller 3 does not need to be shaped so that it appears inversely crowned in front (rear) view, as shown in FIG. 8. For example, it may be shaped so that the lengthwise center portion of the pressure roller 3 and the lengthwise end portions of the pressure roller 3 are roughly the same in diameter.

The pressure roller 3 is disposed on the bottom side of the belt unit 1. The pressure roller 3 is disposed so that its axial line is roughly parallel to the lengthwise direction of the belt unit 1. The pressure roller 3 is rotatably disposed between the lateral plates (walls) 61R and 61F of the apparatus frame 6, with its lengthwise end portions being borne by a pair of bearings (unshown) with which the lateral plates (walls) 61R and 61F are provided, one for one.

The pressure roller 3 is rotationally driven by a pressure roller driving mechanism 208 that is controlled by the driving mechanism controlling portion 207 (FIG. 10) of the controlling portion 200. Although the details of the structure of the driving mechanism 208 are not illustrated, the driving mechanism 208 is made up of a motor, a gear train, etc.

(3) Pressure Applying Mechanism (Pressing Mechanism)

The flanges 16R and 16F of the belt unit 1 are engaged with the lateral plates (walls) 61R and 61F of the apparatus frame 6 in such a manner that they are allowed to slide relative to the lateral plates 61R and 61F in the direction to cause the belt unit 1 to move toward, or away from, the pressure roller 3.

Referring to FIG. 4, there is disposed a compression spring 63R, in a compressed state, between the spring seat 16*b* of the flange 16R and the spring seat 62R of the corresponding end portion of the apparatus frame 6. Similarly, there is disposed a compression spring 63F, in a compressed state, between the spring seat 16*b* of the other flange 16F, and the spring seat 62F of the other end portion of the apparatus frame 6.

Thus, the lengthwise end portions of the stay 14 remain under a preset amount of downward force applied thereto by the resiliency of the compression springs 63R and 63F, by way of the flanges 16R and 16F. Thus, the padding member 13 having the pad 12, and the pressure roller 3, are caused to press upon each other by a preset amount of pressure. Thus, the nip N having a preset width in terms of the recording paper conveyance direction a is formed between the belt 11 and the pressure roller 3. The pad 12 is shaped so that it crowns toward the pressure roller 3 in such a manner that its center portion, in terms of the lengthwise direction, protrudes toward the pressure roller 3, relative to its lengthwise end portions. The amount of crowning of the pad 12 is such that the difference in thickness between the lengthwise center portion of the pad 12 and the lengthwise end portions is 1.4 mm.

Further, the image forming apparatus 100 is provided with a pressure removing mechanism 209 (FIG. 10) for removing the pressure applied to the nip N by the above-described pressure applying mechanism, although the drawings do not show the details. The pressure removing mechanism 209 is made up of a motor, a lever, etc., for example. It is controlled by the driving force controlling portion 207 of the control portion 200 so that it can be put in a state in which it remains inactive, or a state in which it acts on the pressure applying mechanism.

As the pressure removing mechanism 209 is controlled to be inactive, the nip N having the preset width is formed between the belt 11 and the pressure roller 3 by the pressure applying operation of the pressure applying mechanism. As the pressure removing mechanism 209 is controlled to be active, the flanges 16R and 16F are relieved from the downward pressure applied thereto by the compression springs 63R and 63F of the pressure applying mechanism. That is, pressure is removed from the nip N (nip elimination).

When the image forming apparatus 100 is not forming an image, for example, when the image forming apparatus 100 is on standby, or in the like status, the control portion 200 keeps the pressure removing mechanism 209 active to prevent the formation of the nip N, thereby preventing the pressure roller 3 from being deformed in the pattern of the nip N. On the other hand, during an image forming operation, the control portion 200 keeps the pressure removing mechanism 209 inactive to form the nip N and to provide the nip N with a preset amount of pressure.

(4) Coil Unit

The coil unit 2 is disposed on the top side of the belt unit 1. By the way, the coil unit 2 was excluded from FIG. 4 for convenience sake. The coil unit 2 is a combination of an excitation coil 21 (a coil that generates a magnetic flux), an outer core 22 (outer magnetic core), a housing 23, etc. The excitation coil 21, the outer core 22, etc., are disposed in the housing 23 that is long and narrow relative to the lengthwise direction that is parallel to the widthwise direction of the belt 11. Part (a) of FIG. 5 is a schematic perspective view of the coil unit 2.

The housing 23 is in the form of a long and narrow rectangular box. The housing 23 is molded of a heat resistant resin, and is disposed so that its bottom plate 23*a* faces the belt 11. The bottom plate 23*a* is sized and shaped so that it covers roughly one half of the outward surface of the belt 11, in terms of the circumferential direction of the belt 11, with the presence of a preset amount of a gap $\alpha$ between itself and the belt 11.

The coil unit 2 is supported by the flanges 16R and 16F. More specifically, the end portions of the housing 23 of the coil unit 2 are supported by the flanges 16R and 16F. Thus, the bottom plate 23*a* of the housing 23 faces the upwardly facing portion of the outward surface of the belt 11, with the presence of a preset amount of the gap $\alpha$. The coil unit 2 is fixed to the belt unit 1, and the lateral plates of the housing 23 of the coil unit 2 are bound to the flanges 16R and 16F, respectively, with the use of wire springs (unshown).

As the electrical wire for the coil 21, Litz wire is used. The Litz wire is wound so that the resultant coil 21 is shaped like the bottom portion of a boat, and conforms in shape to the inward surface of the belt 11. The Litz wire is disposed in the housing 23 in such a manner that it contacts the inward surface of the bottom plate 23*a* that is concave inward of the housing 23. Through the coil 21, a high frequency current that is 20 Hz to 50 kHz in frequency is flowed from an electrical power source (excitation circuit) 211 (FIG. 10). Consequently, a magnetic field is generated by the coil 21. Thus, heat is generated in the substrative layer 11*a* (conductive layer) by the current induced by the magnetic field.

The outer core 22 is a magnetic core that covers the coil 21 so that the magnetic field generated by the coil 21 does not leak outward of the coil unit 2, and reaches only the substrative layer 11*a* of the belt 11. Referring to part (a) of FIG. 5, the outer core 22 is a collection of multiple sections aligned in the lengthwise direction.

The belt 11 is electrically insulated from the excitation coil 21 of the coil unit 2 by a molded member that is 0.5 mm in thickness. The distance between the belt 11 and the excitation coil 21 is kept steady at 1.5 mm (distance between a surface of a molded member and that of the belt 11 is 1.5 mm). Thus, the belt 11 is uniformly heated. As described above, as the high frequency electrical current that is 20 Hz to 50 kHz in frequency is flowed through the excitation coil 21, heat is inductively generated in the substrative layer 11*a* of the belt 11. As the heat is generated, the control portion 200 varies the high frequency current in frequency, based on the value detected by the temperature sensor THa, in order to control the electrical power to be inputted into the excitation coil 21 to control the belt 11 in temperature.

The coil unit 2 having the excitation coil 21 is not disposed on the inward side of the loop (belt loop) that the belt 11 forms. Rather, the coil unit 2 is disposed on the outward side of the belt loop. Thus, the excitation coil 21 is unlikely to become excessively high in temperature. Further, the excitation coil 21 is unlikely to excessively increase in electrical resistance. That is, this setup makes it possible to minimize the loss attributable to the generation of Joule's heat. Furthermore, the positioning of the excitation coil 21 on the outward side of the belt loop makes it possible to reduce the belt 11 in diameter (i.e., in thermal capacity), and, therefore, to reduce the coil unit 2 (fixing apparatus 300) in energy consumption.

The fixing apparatus 300 in this embodiment is structured to be extremely small in thermal capacity to reduce the length of time it takes for the fixing apparatus 300 to warm-up (warm-up time). Thus, it takes only 15 seconds or so for the temperature of the belt 11 to reach 180° C., or the target level, after 1200 W of electrical power begins to be inputted into the excitation coil 21. Thus, the fixing apparatus 300 does not require to be heated while it is kept on standby. That is, this structural arrangement makes it possible to keep the fixing apparatus 300 extremely low in electrical power consumption.

(5) Heat Distribution Roller

The heat distribution roller 41 is a heat absorbing rotational member that absorbs heat from the pressure roller 3 by being placed in contact with the pressure roller 3. It is rotatably supported by a supporting frame 42. The combination of the heat distribution roller 41 and the supporting frame 42 makes up the heat distribution roller unit 4. The heat distribution roller unit 4 is structured as follows. The heat distribution roller 41 is supported by the supporting frame 42 in parallel to the pressure roller 3, and the supporting frame 42 is supported so that it is enabled to slide relative to the lateral plates 61R and 61F of the apparatus frame 6 in the direction to move toward, or away from, the pressure roller 3.

The heat distribution roller unit 4 is movable by a contact-separation mechanism 210 that is controlled by the driving force controlling portion 207, to a contact position A (position indicated by solid line in FIG. 3), in which the heat distribution roller 41 remains in contact with the pressure roller 3, and a noncontact position B (indicated by two-dot chain line) (disengagement position, separation position), in which the heat distribution roller 41 remains separated from the pressure roller 3 by a preset distance. That is, the control portion 200 can move the contact-separation mechanism 210 in the direction to cause the heat distribution roller 41 to come into contact with the pressure roller 3, and in the direction to cause the heat distribution roller 41 to separate from the pressure roller 3. In other words, the fixing apparatus 300 is structured so that the heat distribution roller 41 can be placed in contact with, or separated from, the pressure roller 3.

Although the drawings do not show the details of the structure of the contact-separation mechanism 210, a shifting mechanism having a motor and a cam, a shifting mechanism having a solenoid tray bar, or the like, may be employed as the contact-separation mechanism 210, as fits.

The heat distribution roller 41 is provided to prevent the out-of-sheet-path portions of the belt 11 from abnormally (excessively) increasing in temperature, by absorbing, from the pressure roller 3, the excessive amount of heat from the out-of-sheet-path portions of the belt 11, and dispersing the heat from the pressure roller 3. That is, the heat distribution roller 41 has a function of enhancing the heat transfer in the pressure roller 3.

It is desired that the heat distribution roller 41 is made of such a material that is no less than 100 W/m·K in thermal conductivity when its temperature is in a range of 100° C. to 250° C., and no more than 3.0 kJ/$m^3$·K in thermal capacity when its temperature is in a range of 100° C. to 250° C. More specifically, the material is desired to be aluminum, copper, or the like. The heat distribution roller 41 is 8 mm in its shaft diameter, 20 mm in diameter, and 380 mm in length L4 (FIG. 9). In addition, the heat distribution roller 41 is a solid roller.

Further, the heat distribution roller 41 may be provided with a surface layer that is 10 μm to 20 μm in thickness and that is formed of fluorinated substance, such as PFA, in order to prevent such foreign substances as ordinary dust, offset toner from the pressure roller 3, paper dust, etc., from adhering to the heat distribution roller 41.

If the heat distribution roller 41 remains in contact with the pressure roller 3 from the beginning of the startup of the fixing apparatus 300 (while a temperature of fixing apparatus 300 is the same as ambient temperature), the heat distribution roller 41 robs heat from the belt 11 through the pressure roller 3, and, therefore, the fixing apparatus 300 fails to quickly start up.

Therefore, until a certain amount of heat is stored in the fixing apparatus 300 by the sheet conveyance through the fixing apparatus 300, the heat distribution roller 41 is kept away from the pressure roller 3. In this embodiment, the control portion 200 is provided with a counter 205 (FIG. 10) for estimating the amount of heat stored in the fixing apparatus 300. The counter 205 increases in value each time a sheet P of recording paper moves through the fixing apparatus 300.

More specifically, in this embodiment, there is disposed a post-fixation sensor 30 (FIG. 3) on the downstream side of the nip N in terms of the recording paper conveyance direction. As the trailing edge of a sheet P of recording paper moves past the post-fixation sensor 30, it is determined that the sheet P moved past the fixing apparatus 300, and the counter 205 is increased in value. In a case in which the dimension of a sheet P of recording paper in terms of the recording paper conveyance direction a is greater than that of a sheet P of recording paper of size A4, the counter is increased by 2 per sheet P, whereas, in a case in which a sheet P of recording paper used for an image forming operation is no more in size than a sheet P of recording paper of size A4, the counter 203 for estimating the amount of the heat stored in the fixing apparatus 300 is increased by 1 per sheet P. The control portion 200 controls the contact-separation mechanism so that, as the value in the counter 205 exceeds 25, the contact-separation mechanism 210 places the heat distribution roller 41 in contact with the pressure roller 3.

By the way, the image forming apparatus 100 is configured so that, while no sheet P of recording paper is conveyed through the fixing apparatus 300, the counter 205 is reduced in value for every preset length of time. More concretely, in this embodiment, the value in the counter 205 is reduced by a numerical value obtainable by multiplying the length (in seconds) of time that has elapsed since the ending of a printing job (image formation job: JOB) by 0.5. Therefore, in a case in which a job interval is sufficiently long, the counter 209 is made to count up from zero, whereas, in a case in which the job interval is short, the following job begins while a certain value is in the counter 205.

In this embodiment, while the heat distribution roller 41 is in contact with the pressure roller 3, a rotational driving force is transmitted from the pressure roller 3 to the heat distribution roller 41 by the friction between itself and rotating pressure roller 3. The heat distribution roller 41 is rotated by the rotation of the pressure roller 3.

A contact-separation detecting portion 220 detects whether the heat distribution roller 41 is in contact with, or away from, the pressure roller 3. The selection of the detecting means of the detecting portion 220 is optional, and so is the selection of the structure of the contact-separation detecting portion 220. In this embodiment, the contact-separation detecting portion 220 is structured so that it detects whether or not the heat distribution roller 41 is in contact with the pressure roller 3, based on the state of the contact-separation mechanism 210. That is, a flag is attached to the shaft of the contact-separation cam (unshown) with which the contact-separation mechanism 210 is provided. Further, a photo-interrupter is paired with this flag.

The flag rotates with the engagement-disengagement cam for moving the heat distribution roller unit 4 to the engagement position A, or the disengagement position B. In this embodiment, the position of the heat distribution roller unit 4 is determined with the use of the photo-interrupter that uses the flag to block the beam of light, or allows the beam of light to transmit. More specifically, when the beam of light is not allowed to transmit (photo-interrupter: OFF), the control portion 200 determines that the heat distribution roller unit 4 is in the engagement position A. That is, the control portion 200 determines that the heat distribution roller 41 is in contact with the pressure roller 3. When the beam of light is allowed to transmit through the photo-interrupter (photo-interrupter: ON), the control portion 200 determines that the heat distribution roller unit 4 is in the disengagement position B. That is, the controller 200 determines that the heat distribution roller 41 is not in contact with the pressure roller 3.

(6) Cooling Fan

The cooling fans Fa, Fb, and Fc are provided to prevent the pressure roller 3 and the heat distribution roller 41 from abnormally increasing in temperature. They are disposed at three positions, one for one, on the upstream side of the combination of the pressure roller 3 and the heat distribution roller 41 in terms of the recording paper conveyance direction. The cooling fan Fa sends cooling air to the lengthwise center portion of the pressure roller 3, and to that of the heat distribution roller 41. The cooling fan Fb sends cooling air to one of the lengthwise end portions of the pressure roller 3, and to the corresponding lengthwise end portion of the heat distribution roller 41. The cooling fan Fc sends cooling air to the other lengthwise end portion of the pressure roller 3 and to the corresponding lengthwise end portion of the heat distribution roller 41. The image forming apparatus 100 is configured so that the cooling fans Fa, Fb, and Fc are turned on by the control portion 200 with preset timing to cool both the heat distribution roller 41 and the pressure roller 3.

FIG. 9 is a drawing for showing the length of each of the essential structural members of the fixing apparatus 300 in this embodiment, and the positional relationship between each of the essential structural members and the temperature sensors THa, THb, and THc. A referential code L11 stands for the length of the belt 11 that is 390 mm in this embodiment. A referential code W11 stands for the maximum heat generation width of the belt 11. The maximum heat generation width means the width of the area of the belt 11 that can be caused to inductively generate heat. In this embodiment, the maximum heat generation width of the belt 11 is 330 mm.

In the case of the fixing apparatus 300 in this embodiment, when the image forming apparatus 100 is turned on, or an image forming job is started, the control portion 200 controls the electrical current that is to be flowed to the excitation coil 21 to heat the belt 11, before a sheet P of recording enters the nip N. The maximum heat generation width of the belt 11 is 330 mm. By the way, the temperature variation within the heat generation area of the belt 11 falls within ±15° C.

A referential code L3 stands for the length of the pressure roller 3 that is 370 mm in this embodiment. Thus, in terms of the direction parallel to the axial line of the pressure roller 3, the dimension of the nip N that is the area of contact between the belt 11 and the pressure roller 3 is the same as the length L3 of the pressure roller 3, and, therefore, is 370 mm. A referential code L4 stands for the length of the heat distribution roller 41 that is 380 mm in this embodiment. A referential code O stands for the referential line (theoretical line that coincides with a center of recording paper passage in terms of a direction perpendicular to the recording paper conveyance direction) for recording paper conveyance. A referential code WPmax stands for the path of the largest (in terms of a widthwise direction of the pressure roller 3) sheet of recording paper that is usable with the fixing apparatus 300 (image forming apparatus 100). In this embodiment, the widest sheet of recording paper, in terms of the direction parallel to the pressure roller 3, usable with the image forming apparatus 100 (and the fixing apparatus 300) is 330 mm.

The central temperature sensor THa is disposed so that its position roughly coincides with that of the referential line O. The central temperature sensor THa detects the temperature of the center portion of the belt 11. That is, the central temperature sensor THa detects the temperature of the portion of the belt 11 that all the sheets P of recording paper pass regardless of their width (size). The information regarding the temperature of the belt 11 detected by the central temperature sensor THa is fed back to the control portion 200.

The control portion 200 controls the electrical power to be inputted into the coil 21 from the electrical power source 211, so that the detected temperature level inputted from the temperature sensor THa remains at a preset target level (fixation temperature). That is, as the detected temperature of the belt 11 increases to the target level, the power supply to the coil 21 is shut off. In this embodiment, while the power source is started up, the high frequency current that is to be flowed to the coil 21 is changed in frequency based on the temperature level detected by the central temperature sensor THa to control the electrical power to be inputted into the coil 21, in order to ensure that the belt temperature reaches the target level and remains at the target level.

The peripheral temperature sensors THb and THc are disposed so that they correspond in position to the lengthwise end portions of the belt 11. More specifically, in terms of the direction parallel to the widthwise direction of the belt 11, they are positioned 160 mm, for example, away from the center of the belt 11. The peripheral temperature sensors THb and THc are desired to be in the adjacencies of the edge of the path of the widest sheet P of recording paper. More specifically, the peripheral temperature sensors THb and THc are desired to be 150 mm to 165 mm away from the widthwise center of the belt 11.

Next, the block diagram of the control system, shown in FIG. 8, is described. The control portion 200 has a CPU 203 (central processing unit), a memory 204, the fixing apparatus heat accumulation counter 205, a recording paper information processing portion 206, and the driving force controlling portion 207. The control portion 200 integrally controls the entirety of the combination of operational systems and mechanisms of the image forming apparatus 100.

The control panel 202 is a user interface (UI: inputting means, displaying means) through which electrical information can be exchanged between the control portion 200 and a user. It is through this control panel 202 that a user (operator) can input the choice of image formation mode, various operational commands, etc., into the control portion 200. Further, information, such as the state of the image forming apparatus 100, is sent to the control panel 202 to be displayed for the user.

The control panel 202 has a main switch M-SW, an inputting portion 202A (inputting panel), and a display 202B (user IU). The inputting portion 202A is provided with various keys, such as a group of ten keys for the inputting of numerical values, a print start button, a stop key, and an economy mode button. The display 202B is a liquid crystal touch panel that displays not only various information regarding the selections of the type of recording paper that can be used with the image forming apparatus 100, but also, various buttons that a user can touch to input his or her selections. It is also through the displayed buttons that a user can input various settings for the operation to be carried out by the image forming apparatus 100.

To the recording paper information processing portion 206, information regarding the type, size, etc., of the recording paper selected by a user for a specific image formation job is sent from the control panel 202 or an external host apparatus 400 (external terminal).

The fixation apparatus heat accumulation counter 205 counts the sheets P of recording paper that have just been moved through the fixing apparatus 300. The driving force controlling portion 207 controls the driving and non-driving of the various mechanisms 208 to 212, cooling fans Fa, Fb, and Fc, etc. In the memory 204, various data for sending commands to various portions of the image forming apparatus 100 are stored.

(7) Fixing Operation

While the image forming apparatus 100 is kept on standby, the pressure roller 3 of the fixing apparatus 300 is not rotated. Further, the power to the coil 21, and the power to the cooling fans Fa, Fb, and Fc are also turned off.

The control portion 200 begins to carry out an image formation sequence in response to the inputting of a print job start signal (image formation job start signal). As for the fixing apparatus 300, the control portion 200 turns on the pressure roller driving mechanism 208 to rotationally drive the pressure roller 3 in the counterclockwise direction indicated by an arrow mark R3 in FIG. 3.

As the pressure roller 3 rotates, a rotational force is transmitted from the pressure roller 3 to the belt 11 by the friction between the peripheral surface of the pressure roller 3 and the outward surface of the belt 11, in the nip N. Thus, the belt 11 is rotated by the rotation of the pressure roller 3 around the components 12 to 15 of the inner assembly in the clockwise direction indicated by an arrow mark R11 in FIG. 3, at the same speed as the peripheral velocity of the pressure roller 3, with the inward surface of the belt 11 sliding on the pad 12 (in contact with the pad 12). The movement of the belt 11 in the thrust direction that occurs as the belt 11 is rotated is regulated by the inwardly facing surfaces 16*a* and 16*a* of the flanges 16R and 16F, respectively.

By the way, the substrative layer 11*a* of the belt 11 is formed of a metallic substance. As for the means for regulating the lateral deviation of belt 11 that sometimes occur as the belt 11 is rotated, the provision of the flanges 16R and 16F that simply catch the belt 11 by the edges of the belt 11 is sufficient. Thus, the present invention is beneficial also in that it can simplify the fixing apparatus 300 in structure.

Further, the control portion 200 supplies the excitation coil 21 with a high frequency current from the electrical power source 211. As the excitation coil 21 is supplied with the high frequency current, it generates alternating magnetic flux (magnetic field). This magnetic field is guided to the metallic layer 11*a* of the rotating belt 11, by the core 22, on the top side of the belt 11. Thus, an eddy current generates in the metallic layer 11*a*. This eddy current generates heat (Joule's heat) in the metallic layer 11*a*. The metallic layer 11*a* itself generates heat (heat generation by electromagnetic induction). Consequently, the belt 11 increases in temperature.

That is, a given portion of the rotating belt 11 moves through an area, in which the magnetic field generated by the coil unit 2 is present, the metallic layer 11*a* of this portion of the rotating belt 11 is heated by electromagnetic induction. Thus, as the belt 11 is circularly moved, the entirety of the belt 11 is heated, and, therefore, increases in temperature. The temperature of the belt 11 is detected by the temperature sensor THa, and the information regarding the detected temperature is fed back to the control portion 200. The control portion 200 controls the amount by which electrical power is to be supplied to the excitation coil 21 from the electrical power source 211, so that the detected temperature level (information regarding detected temperature level) inputted from this sensor THa, remains at the preset target level (fixation temperature: information regarding preset temperature level).

In this embodiment, in order to keep the belt temperature stable at the target level, or 180° C., the high frequency current is changed in frequency, based on the temperature value detected by the temperature sensor THa to control the amount by which electrical power is to be inputted into the coil 21. The temperature of the belt 11 is adjusted by changing the high frequency current in frequency.

While the pressure roller 3 is driven as described above, and the belt temperature is kept at the preset level (fixation temperature) after being increased to the preset level, a sheet P of recording paper that bears an unfixed toner image t is guided into the nip N, with the toner image bearing surface of the sheet P facing the belt 11. Then, the sheet P is conveyed through the nip N with the belt 11, while remaining sandwiched between the belt 11 and the pressure roller 3, and, therefore, remaining in contact with the outward surface of the belt 11.

Thus, heat is transferred to the sheet P of recording paper and to the toner image thereon, primarily from the belt 11. Further, as the sheet P is conveyed through the nip N, the unfixed toner image t is also subjected to the internal pressure of the nip N. Thus, the unfixed toner image t is fixed to the surface of the sheet P (thermal fixation). After being conveyed through the nip N, the sheet P is separated from the outward surface of the belt 11 by the deformation of the belt 11 that occurs at the exit portion of the nip N. The sheet P is separated from the outward surface of the belt 11 by the curvature of the pressure roller 3, while being assisted by the separation guide 19*a*. Then, the sheet P is guided out of the fixing apparatus 300 by a guiding member 19*b*. In this embodiment, the belt 11 is rotated at 330 mm/sec in terms of the moving speed of its outward surface. The belt 11 can fix eighty color images formed on a sheet P of recording paper of size A4, or fifty-eight color images formed on a sheet P of recording paper of size A4R, per minute.

Figure 1:
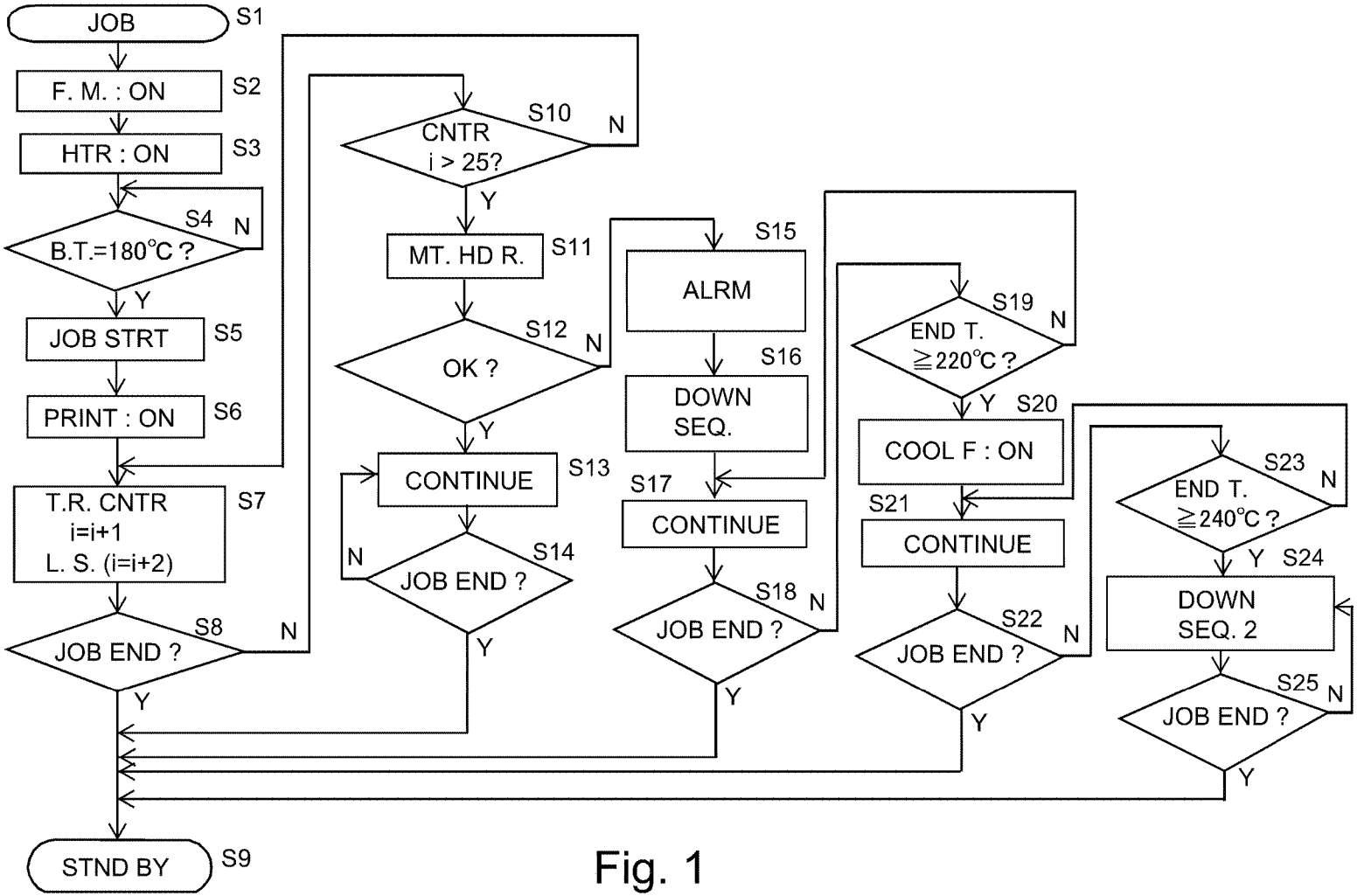
FIG. 1 is a flowchart of the control sequence in the first embodiment of the present invention.

(8) Control Sequence for Placing Heat Distribution Roller in Contact with, or Separating Heat Distribution Roller from, Pressure Roller Next, referring to FIGS. 1 and 10, the control sequence for placing the heat distribution roller 41 in contact with the pressure roller 3, or separating the heat distribution roller 41 from the pressure roller 3, is described. As the image forming apparatus 100 is turned on, or an image formation job is started (S1), the control portion 200 changes the pressure applying mechanism 209 in state from the active state to inactive state. Thus, the belt unit 1 that was not under the pressure is pressed upon the pressure roller 3 by the pressure applying mechanism. Consequently, the nip N is formed.

Next, the control portion 200 turns on the pressure roller driving mechanism 203 to begin to rotationally drive the pressure roller 3 (S2). As the pressure roller 3 is rotationally driven, the belt 11 is rotated by the rotation of the pressure roller 3. Next, the control portion 200 applies electrical voltage to the excitation coil 21 to increase the temperature of the belt 11 to 180° C. (preset level), and begins to control the belt 11 in temperature so that the temperature of the belt 11 remains at the preset level (S3, S4). At this point in time, the heat distribution roller unit 4 is in the disengagement position B, in which the heat distribution roller 41 is not in contact with the pressure roller 3.

As the fixing apparatus 300 finishes starting up, the control portion 200 begins a printing job (image formation job: JOB) (S5). At this point in an image forming operation in which sheets P of recording paper are continuously conveyed, the sheet conveyance interval is the same as the sheet conveyance interval (first conveyance interval) for an ordinary printing job.

As the value in the fixation apparatus heat accumulation counter 205 exceeds 25 (S6-S8, S10), the control portion 200 causes the heat distribution roller unit moving mechanism 210 to move the heat distribution roller unit 4 from the noncontact position B to the contact position A. Thus, the heat distribution roller 41 is placed in contact with the pressure roller 3 (S11).

At this point in the operation, the control portion 200 determines whether or not the heat distribution roller moving mechanism 210 is actually operated, that is, whether or not the heat distribution roller 41 that had been kept away from the pressure roller 3 was placed in contact with the pressure roller 3 (S12).

More concretely, the control portion 200 outputs to the heat distribution roller moving mechanism 210, a movement control signal for moving the heat distribution roller unit 4 from the noncontact position B to the contact position A, in Step S11. If a light transmission signal (ON signal) inputted from the interrupter of the contact-noncontact detecting portion 220 turns into a light blocking signal (OFF signal) within a preset length of time, the control portion 200 determines that the heat distribution roller 41 is in contact with the pressure roller 3 (successful placement of heat distribution roller in contact with pressure roller 3).

Further, in a case in which all that occurs is the continuation of the inputting of the light transmission signal (ON signal), the control portion 200 determines that the heat distribution roller moving mechanism 210 is remaining inactive, and, therefore, the heat distribution roller 41 has not changed in state from being not in contact with the pressure roller 3 to being in contact with the pressure roller 3 (failure in operation to place heat distribution roller in contact with the pressure roller 3). The fact that the control portion 200 determined that the operation to place the heat distribution roller in contact with the pressure roller 3 was unsuccessful indicates that such an abnormal state that the heat distribution roller 41 remains separated from the pressure roller 3.

On the other hand, if the control portion 200 determines that the heat distribution roller moving operation was successful in Step S12, the control portion 200 continues the current printing operation, while keeping the heat distribution roller 41 in contact with the pressure roller 3 until the current printing operation normally ends (S13, S14).

If the control portion 200 determines that the heat distribution roller moving operation was unsuccessful, it displays a warning across the display 202B of the control panel 202 and/or the display portion of the external host apparatus (S15). At the same time, it starts a slowdown sequence that makes the sheet interval wider than the normal one (S16-S18), for the following reason. That is, even if the heat distribution roller 41 could not be placed in contact with the pressure roller 3, it is possible to make the belt 11 and the pressure roller 3 uniform in temperature in terms of their lengthwise direction, by increasing the image forming apparatus 100 in sheet conveyance interval, that is, by reducing the image forming apparatus 100 in productivity. That is, it is possible to prevent the out-of-sheet-path portions of the belt 11 from excessively increasing in temperature.

The slowdown sequence is an operational sequence in which a printing job is carried out with the recording medium conveyance interval set to the second value that is greater than the first value to which the sheet conveyance interval is set in an ordinary printing job.

In this embodiment, in the slowdown sequence, the image forming apparatus 100 is adjusted in sheet conveyance interval so that the apparatus 100 reduces in productivity to 80% compared to the normal sequence (100%).

At the same time, a warning is issued in the image forming apparatus 100 to inform a person in charge, in order to inform a service personnel that the heat distribution roller moving mechanism 210 is having a problem. Further, the control portion 200 causes the display portion 202B of the control panel 202 and/or display portion of the host apparatus to display a message that the image forming apparatus 100 needs to be serviced, in order to suggest that a user informs service personnel of the occurrence of a trouble.

By the way, the image forming apparatus 100 is designed so that normally, it takes three seconds for the heat distribution roller moving mechanism 210 to move the heat distribution roller from the preset position in which the heat distribution roller 41 is not in contact with the pressure roller 3 to the preset position in which the heat distribution roller 41 remains in contact with the pressure roller 3. Thus, it takes no less than three seconds for the photo-interrupter to be turned off. Thus, in Step S12, in which it is determined whether or not the heat distribution roller moving operation was successful, if the photo-interrupter is changed in state (ON/OFF) after the elapse of five seconds, the control portion 200 determines that the operation was unsuccessful.

If the printing job is continued after the image forming apparatus 100 was reduced in productivity (NO in S18), the out-of-sheet-path portions of the belt 11 gradually increase in temperature in spite of the reduction in the productivity of the image forming apparatus 100. In this embodiment, the image forming apparatus 100 is provided with temperature sensors THb and THc that are disposed in the adjacencies of the lateral edges of the belt 11, one for one. Therefore, it is possible to detect the temperature of the out-of-sheet-path portions of the belt 11.

As the temperature detected by the temperature sensor THb or THc exceeds 220° C., the peripheral cooling fans Fb and Fc are turned on (S19, S20). The peripheral cooling fans Fb and Fc are provided to cool both the heat distribution roller 41 and the pressure roller 3. Even if the heat distribution roller 41 fails to be placed in contact with the pressure roller 3, however, the pressure roller 3 can be cooled, although it cannot be cooled as effectively as intended.

If the increase in temperature across the out-of-sheet-path portions of the belt 11 does not slow down even after the on-going printing job continued for a substantial length of time (S19, S20), as the temperature detected by the temperature sensor THb or THc exceeds 240° C. (S23), the control portion 200 starts a slowdown sequence 2, in which the recording paper intervals are even wider (S24, S25). In this embodiment, the sheet intervals are adjusted so that the image forming apparatus 100 reduces in productivity to 30% of its normal one (100%).

The above-described control sequences can be summarized as follows. In a case in which it is detected by the contact/noncontact detecting portion 220 that the operation for placing the heat distribution roller 41 in contact with the pressure roller 3 was successful during the printing job carried out by the control portion 200 after the control portion 200 controlled the heat distribution roller moving mechanism 210 to move the heat distribution roller 41 toward the pressure roller 3, the control portion 200 causes the image forming apparatus 100 to carry out the normal job sequence. In a case in which the operation for placing the heat distribution roller 41 in contact with the pressure roller 3 was unsuccessful, the control portion 200 causes the image forming apparatus 100 to enter the slowdown sequence.

That is, when the image forming apparatus 100 is in such an abnormal state that the heat distribution roller 41 remains separated from the pressure roller 3, it is impossible to deal with the problem that as a substantial number of sheets P of recording paper that are narrower than the widest sheet P of recording paper usable with the image forming apparatus 100 are continuously conveyed through the fixing apparatus 300 for image fixation, the out-of-sheet-path portions of the belt 11 excessively increase in temperature. Thus, the image forming apparatus 100 is increased in recording sheet conveyance interval. That is, as it is detected by the detecting portion 220 that the image forming apparatus 100 is in such an abnormal state that the heat distribution roller 41 remains separated from the pressure roller 3, in spite of the issuance of a command to place the heat distribution roller 41 in contact with the pressure roller 3, by the control portion 200, the control portion 200 controls the image forming apparatus 100 so that sheets P of recording paper are introduced into the nip N, with the sheet conveyance interval set to the first value. Thereafter, the control portion 200 causes the image forming apparatus 100 to introduce sheets P of recording paper into the nip N, with the sheet conveyance interval set to the second value that is greater than the first value.

In a case in which the above-described abnormal state has not been detected by the detecting portion 220, not only does the control portion 200 cause the image forming apparatus 100 to introduce sheets P of recording paper with the sheet conveyance interval set to the first value for a preset length of time, but the control portion 200 also places the heat distribution roller 41 in contact with the pressure roller 3 (S11). The "preset length of time" means the length of time (S10) it takes for the number of the sheets P of recording paper processed by the fixing apparatus 300 to reach a preset value. By the way, the preset length of time may be the length of time that the fixing apparatus 300 has been operated since the start of a given printing job to reach a preset value.

As described above, in this embodiment, even after it is determined that the heat distribution roller 41 failed to be placed in contact with the pressure roller 3, that is, even after it is determined that the heat distribution roller moving mechanism 210 failed to place the heat distribution roller 41 in contact with the pressure roller 3, the image forming apparatus 100 can be continuously operated as long as it is reduced in operational speed (slowdown sequence).

As soon as the printing job is completed (S8, S14, S18, S22 and S25), the control portion 200 puts the image forming apparatus 100 on standby, and waits for the inputting of the next printing job (S9).

As the control portion 200 puts the image forming apparatus 100 on standby, it stops adjusting the fixing apparatus 300 in temperature, and turns off the pressure roller driving mechanism 208. Then, the control portion 200 activates the pressure removing mechanism 209 that was kept inactive, in order to keep the nip N free of pressure. On the other hand, if the heat distribution roller 41 is in contact with the pressure roller 3, the control portion 200 activates the heat distribution roller moving mechanism 209 to separate the heat distribution roller 41 from the pressure roller 3. That is, the control portion 200 causes the heat distribution roller moving mechanism 210 to move the heat distribution roller unit 4 from the contact position A to the noncontact position B.

By the way, the peripheral cooling fans Fb and Fc may be kept turned on for a preset length of time, or until the temperature detected by the peripheral temperature sensors THb and THc comes down to a preset level, according to the level of the temperature detected by the peripheral temperature sensors THb and THc at the completion of the job. In such a case, it is desired that the pressure roller 3 is rotated to rotate the belt 11, in order to efficiently reduce the belt 11 in temperature.

In this embodiment, the image forming apparatus 100 was reduced in operational speed (first and second slowdown sequences), and also, the peripheral cooling fans Fb and Fc were activated according to the value of the temperature detected by the peripheral temperature sensors THb and THc. The number of the slowdown sequence may, however, be only one. Further, the fixing apparatus 300 does not need to be provided with peripheral cooling fans Fb and Fc.

Embodiment 2

Next, the second embodiment of the present invention is described. By the way, the operation of the main assembly 101 of the image forming apparatus 100 in this embodiment, and that of the fixing apparatus 300 in this embodiment are similar to those of the counterparts in the first embodiment, and, therefore, are not described. The second embodiment relates to the operational sequence to be carried out when it becomes impossible for the heat distribution roller 41 to be separated from the pressure roller 3 after it is placed in contact with the pressure roller 3, that is, when the heat distribution roller 41 gets stuck in the contact position A.

FIG. 11 shows a flowchart of the post-image formation operational sequence of the image forming apparatus 100 in this embodiment. As soon as a printing job is completed (S25), the control portion 200 puts the image forming apparatus 100 on standby, and waits for the inputting of the next printing job. At this point in time, the control portion 200 stops controlling the fixing apparatus 300 in temperature (S26), and turns off the pressure roller driving mechanism 208 (S27).

Then, the control portion 200 determines, based on the signals inputted from the contact/separation detecting portion 220, whether or not the heat distribution roller 41 is in contact with the pressure roller 3 (S28). More concretely, if the signal inputted from the interrupter of the contact/separation detecting portion 220 is a light transmission signal (ON signal), the control portion 200 determines that the heat distribution roller 41 is not in contact with the pressure roller 3. If the signal from the interrupter is a non-transmission signal (OFF signal), the control portion 200 determines that the heat distribution roller 41 is in contact with the pressure roller 3.

If the control portion 200 determines that the heat distribution roller 41 is not in contact with the pressure roller 3, it puts the image forming apparatus 100 on standby, and waits for the inputting of the next printing job (S32).

In this embodiment, if the control portion 200 determines that the heat distribution roller 41 is in contact with the pressure roller 3, it outputs to the heat distribution roller moving mechanism 210, a movement control signal for moving the heat distribution roller 41 from the noncontact position B to the contact position A, after the elapse of three minutes since the completion of the printing job (S29, S30).

Then, if the ON signal from the interrupter of the contact/separation detecting portion 220 changes into an OFF signal within a preset length of time (five seconds, in this embodiment), the control portion 200 determines that the heat distribution roller 41 has just been placed in contact with the pressure roller 3 (operation for placing heat distribution roller 41 in contact with pressure roller 3 was successful). Then, the control portion 200 puts the image forming apparatus 100 on standby, and waits for the inputting of the next printing job (S31, S32).

On the other hand, if the light transmission signal (ON signal) is continuously inputted in Step S31, the control portion 200 determines that the heat distribution roller moving mechanism 210 was not successful in its operation, and, therefore, the heat distribution roller 41 is remaining in contact with the pressure roller 3 (operation for separating heat distribution roller 41 from pressure roller 3 was unsuccessful). The determination that the operation for separating the heat distribution roller 41 from the pressure roller 3 was unsuccessful means that the fixing apparatus 300 is in such an abnormal state that the heat distribution roller 41 is stuck to the pressure roller 3.

The failure in the operation for separating the heat distribution roller 41 from the pressure roller 3 causes the control portion 200 to output a warning (S33). Then, the control portion 200 puts the image forming apparatus 100 on stand-by, with the alarm remaining turned on, and waits for the inputting of the next printing job (S32).

FIG. 12 is a flowchart of the operational sequence that follows the inputting of the next printing job into the image forming apparatus 100. The steps in FIG. 12 that are the same as the counterparts in FIG. 11, are given the same referential codes as those given to the counterparts, and, therefore, are not described.

If the heat distribution roller 41 remains in contact with the pressure roller 3, it robs heat from the pressure roller 3 (and belt 11) while the fixing apparatus 300 starts up. Thus, if the heat distribution roller separation failure warning is turned on (Y in S40), the control portion 200 checks the value in the fixation apparatus heat accumulation counter 205. If the control portion 200 determines that the value is no more than 25, it puts the image forming apparatus 100 on standby, and causes the image forming apparatus 100 to increase in recording paper conveyance interval (slowdown sequence (S41)). Also in this embodiment, the image forming apparatus 100 is reduced in productivity to 90% of the normal productivity (100%).

The reason why the control portion 200 increases the image forming apparatus 100 in sheet interval is to ensure that the fixing apparatus 300 is enabled to store a sufficient amount of heat for fixation. Instead of increasing the image forming apparatus 100 in sheet interval, however, the target temperature level (fixation temperature) for the fixing apparatus 300 may be raised from the normal level (180° C.) by 10° C. to 20° C. This alternative does not reduce the image forming apparatus 100 in productivity. It possibly subjects the recording paper to an excessive amount of thermal stress, however, being therefor likely to cause recording paper P to wrinkle and/or curl.

If the control portion 200 determines in Step S10 that the value in the counter 205 is greater than 25 (trigger value), the control portion 200 switches the image forming apparatus 100 in sheet interval from the wider interval (slowdown sequence) back into the normal interval (S42). That is, in the case in which the control portion 200 determines that the contact/separation mechanism 210 is not normal in its separating operation, it makes the image forming apparatus 100 continue to introduce sheets of recording paper into the nip N, with the sheet conveyance interval set to the second value (slowdown sequence), until the value in the counter 205 exceeds the preset value (trigger value) for placing the heat distribution roller 41 in contact with the pressure roller 3.

That is, when the fixing apparatus 300 is in such an abnormal state that the heat distribution roller 41 remains stuck in contact with the pressure roller 3, the pressure roller 3 fails to store a sufficient amount of heat for fixation. Thus, the control portion 200 increases the image forming apparatus 100 in sheet conveyance interval, during an image forming operation in which a substantial number of the widest sheets P of recording paper usable with the image forming apparatus 100 are continuously conveyed for the fixation of the images thereon. More specifically, unless it is detected by the detecting portion 220 that the fixing apparatus 300 is in such an abnormal state that the heat distribution roller 41 is stuck in contact with the pressure roller 3, the control portion 200 makes the image forming apparatus 100 introduce sheets P of recording paper, with the sheet conveyance interval set to the first value. On the other hand, as the above-described abnormality is detected by the detecting portion 220, the control portion 200 makes the image forming apparatus 100 introduce sheets P of recording paper, with the sheet conveyance interval set to the second value.

Further, as the above-described abnormality is detected by the detecting portion 220, the control portion 200 makes the image forming apparatus 100 introduce the sheets P of recording paper into the nip N, with the sheet conveyance interval set to the second value (S41) for a preset length of time, and then, it makes the image forming apparatus 100 introduce the sheets P into the nip N, with the sheet conveyance interval set to the first value (S42). That is, as soon as the pressure roller 3 stores a sufficient amount of heat for fixation, the control portion 200 restores the image forming apparatus 100 in sheet conveyance interval to the normal interval. The above-mentioned preset length of time means the length of time necessary for the number of the sheets P of recording paper subjected to the fixing process to reach a preset value (S10). By the way, the preset length of time may be the length of time necessary for the cumulative length of time the fixing apparatus 300 was used to reach a preset value.

In particular, in a case in which the largest sheets P (widest sheets P) usable with the image forming apparatus 100, or sheets P that are substantial in basis weight (no less than 128 g/m$^2$, for example), are conveyed through the fixing apparatus 300, a large amount of heat is robbed from the fixation belt 11. Therefore, the amount by which electrical power has to be supplied to the excitation coil 21 to keep the temperature of the fixation belt 11 at the level for satisfactory fixation is greater.

When the heat distribution roller 41 is in contact with the pressure roller 3, the fixing apparatus 300 is greater in thermal capacity than when the heat distribution roller 41 is not in contact with the pressure roller 3, and also, the fixing apparatus 300 is greater in electrical power consumption. The maximum amount of electrical power that the image forming apparatus 100 can supply to the fixing apparatus 300 is determined, however, by the main assembly 101 of the image forming apparatus 100. Thus, in a case in which the image forming apparatus 100 is controlled in sheet conveyance interval, as described above, the image forming apparatus 100 cannot supply the fixing apparatus 300 with a sufficient amount of electrical power, and, therefore, it is likely to output images that are unsatisfactory in fixation. Thus, it is only when the largest sheets P of recording paper, or sheets P of recording paper that are substantial in basis weight are used that the sheet conveyance interval is set to the second value.

Embodiment 3

Referring to FIG. 13, in this embodiment, the image forming apparatus 100 is provided with a cleaning system 5 for cleaning the heat distribution roller 41, and, more specifically, for removing toner particles and paper dust adhered to the peripheral surface of the heat distribution roller 41. The cleaning system 5 has a cleaning web 51 (cleaning member, paper web), an aluminum shaft 52 (supply shaft, dispensing shaft) from which the cleaning web 51 is unwound (dispensed), an aluminum shaft 53 (take-up shaft) that takes up the cleaning web 51, a cleaning roller 54 formed of sponge, a web moving mechanism 212, etc.

The web moving mechanism 212 has a motor, a ratchet, etc., that are controlled by the control portion 200, although the drawing does not show the details of the web moving mechanism 212. The control portion 200 causes the take-up shaft 53 to intermittently rotate with preset timing so that the paper web 51 is unrolled from a paper web roll fitted around the supply shaft 52, and is taken up by the take-up roller 53, by way of the cleaning roller 54. As the material for the paper web 51, unwoven cloth made of a methane alamido fiber of a methane series, or the like, can be used.

As the heat distribution roller unit 4 is moved to the contact position A, not only does the heat distribution roller 41 come into contact with the pressure roller 3, but also, it is pressed against the cleaning roller 54 through the paper web 51. Further, as the heat distribution roller unit 4 is moved to the separation position B, not only does the heat distribution roller 41 separate from the pressure roller 3, but also, from the cleaning roller 54 by which the paper web 51 is supported by the cleaning roller 54 by wrapping halfway around the cleaning roller 54.

As long as the heat distribution roller 41 and the pressure roller 3 are in contact with the cleaning roller 54, the cleaning system 5 dispenses the paper web 51 by a preset amount each time a sheet P of recording paper passes through the nip N of the fixing apparatus 300. In this embodiment, the paper web 51 is dispensed by 0.02 mm each time two sheets P of recording paper of size A4 pass the fixing apparatus 300.

FIG. 14 is a flowchart of the control sequence in this embodiment (third embodiment). The steps in FIG. 14 that are the same as the counterparts in FIG. 12, showing the flowchart of the control sequence in the second embodiment, are given the same referential codes as those given to the counterparts, and, therefore, are not described.

In a case in which the operation for placing the heat distribution roller 41 in contact with the pressure roller 3 is unsuccessful, the cleaning system 5 for cleaning the heat distribution roller 41 does not operate. Thus, the operation sequence is the same as the one in the first embodiment.

In a case in which the operation for separating the heat distribution roller 41 from the pressure roller 3 is unsuccessful, the subsequent portion of the operational sequence is the same as the one in the second embodiment. That is, if the value in the fixation apparatus heat accumulation counter 205 is no more than twenty-five, the image forming apparatus 100 is put through the slowdown sequence. The heat distribution roller 41 is, however, in contact with the pressure roller 3. Thus, this operation sequence has an additional step (S50) that the operational sequence in the second embodiment does not have.

That is, when the fixing apparatus 300 (image forming apparatus 100) is in the normal condition, that is, when the heat distribution roller 41 can be placed in contact with, or separated from, the pressure roller 3, the paper web 51 is dispensed only when the heat distribution roller 41 is in contact with the pressure roller 3 (as value in fixation apparatus heat accumulation counter 205 exceeds twenty-five). In comparison, in this embodiment (third embodiment), the paper web 44 is dispensed even if the value in the fixation apparatus heat accumulation counter 205 is 2 (since paper web 51 is dispensed for every two sheets of recording paper of size A4) because the fixing apparatus 300 (image forming apparatus 100) is in the condition in which the heat distribution roller 41 cannot be separated from the pressure roller 3.

Embodiment 4

Next, referring to FIGS. 13 and 15, the fourth embodiment of the present invention is described. The cleaning system 5 is designed so that it is only a fresh portion of the paper web 51 that is placed in contact with the heat distribution roller 41 to remove the contaminations (i.e., toner particles and paper dust) on the heat distribution roller 41. Thus, the paper web 51 is rolled up by the shaft 53 so that the paper web 51 is dispensed from the web dispensing shaft 53.

In the fourth embodiment, the dispensing shaft 52 of the fixing apparatus 300 is provided with a detecting portion 213 (FIG. 13) for detecting the amount of the paper web remaining on the dispensing shaft 52. The concrete structure of this detecting portion 213 is not shown in the drawings. As the paper web 51 is dispensed, the paper web roll on the dispensing shaft 52 reduces in external diameter. Thus, the image forming apparatus 100 may be designed so that, if the external diameter of the paper web roll becomes less than a preset value, it is determined that the cleaning system 5 ran out of the paper web 51. The image forming apparatus 100 may be designed, however, so that the last portion of the paper web 51 is provided with a notch so that a beam of light can be transmitted through the notch or blocked by a flag, or the presence of the notch is directly detected by a sensor, in order to find out whether or not the cleaning system 5 ran out of the paper web 51.

FIG. 15 is a flowchart of the image forming operation in this embodiment. The steps in FIG. 15 that are the same as the counterparts in FIG. 1 (flowchart) are given the same referential codes as the counterparts, and, therefore, are not described here.

In this embodiment, the image forming apparatus 100 is designed so that it is usable even after its cleaning system 5 runs out of the paper web 51. Referring to FIG. 15, as the value in the fixation apparatus heat accumulation counter 205 is made to exceed twenty-five by the conveyance of sheets P of recording paper through the fixing apparatus 300, the control portion 200 determines whether or not the cleaning system 5 is out of the paper web 51 (S10, S50). If the cleaning system 5 is not out of the paper web 51, an ordinary operation is carried out, in which the heat distribution roller 41 is placed in contact with the pressure roller 3, and the paper web 51 is taken up (S51-S53).

On the other hand, if the cleaning system 5 is out of the paper web 51, or ran out of the paper web 51 while a sheet P of recording paper is being conveyed through the fixing apparatus 300, the heat distribution roller 41 is separated from the pressure roller 3 (if it is in contact with pressure roller 3), and sheets P are conveyed through the fixing apparatus 300, with the heat distribution roller 41 being kept separated (S55, S56). By the way, if the heat distribution roller 41 is not in contact with the pressure roller 3, sheets P are conveyed through the fixing apparatus 300, with the heat distribution roller 41 left separated from the pressure roller 3 (S55, S56). The operational sequence carried out in this embodiment when the heat distribution roller 41 is not in contact with the pressure roller 3 is the same as that in the first embodiment.

By the way, as the cleaning system 5 runs out of the paper web 51, an "out of paper web" warning is issued (S54). That is, an "out of paper web" warning is sent to a service person, as in a case in which a heat distribution roller moving operation failed. Further, an "out of paper web" message is displayed across the display portion 202B of the control panel 202 so that a user can inform a service person of the warning.

The above-described control sequence can be summarized as follows. If the detecting portion 213 for detecting the residual amount of the paper web 51 detects, during a period in which a printing job is carried out, with the heat distribution roller 41 being in contact with the pressure roller 3, that the cleaning system 5 ran out of the paper web 51, the control portion 200 separates the heat distribution roller 41 from the pressure roller 3, and causes the image forming apparatus 100 to go through the slowdown sequence. Further, the control portion 200 issues a warning.

Therefore, even if the operation for placing the heat distribution roller 41 in contact with, or separating the heat distribution roller 41 from the pressure roller 3, fails, or the cleaning system 5 runs out of the paper web 51, it does not occur that the image forming operation itself is stopped. Thus, it is possible to minimize the length of time the image forming apparatus 100 is inoperable.

By the way, in the embodiments 1 to 4, the image forming apparatus 100 was provided with the heat accumulation counter 205, the value of which is increased by a preset amount each time a sheet P of recording medium is conveyed through the fixing apparatus 300. A means for triggering the operation for placing the heat distribution roller 41 in contact with the pressure roller 3 during an image forming operation does not, however, have to be the counter 205 in the preceding embodiments.

For example, the heat accumulation counter 205 may be configured to count the length of time the fixation belt 11 is heated. More concretely, the image forming apparatus 100 may be designed so that the heat accumulation counter 205 counts the length of time the inductive heating apparatus 2 is supplied with electrical power, and the control portion 200 uses the length of time it takes for the fixation belt 11 to be heated during an image forming operation to reach a preset value, as the trigger to place the heat distribution roller 41 in contact with the pressure roller 3. By the way, the image forming apparatus 100 may be designed so that the counter 205 counts the length of time the out-of-sheet-path portions of the fixation belt 11 were heated.

Further, the image forming apparatus 100 may be designed so that the placement of the heat distribution roller 41 in contact with the pressure roller 3 is triggered by the increase of the temperature of the out-of-sheet-path portions of the fixation belt 11 that is determined based on the output of the temperature sensors THb and THc to a level that is no less than the preset temperature.

[Miscellanies]

(1) The rotational heating member may be a flexible endless belt, such as the belt 11 in the preceding embodiments, that is suspended and tensioned by multiple belt supporting-tensioning members and is circularly moved. Further, the rotational heating member may be a roller.

(2) The pressure roller 3, as a pressure applying rotational member, may be replaced with an endless belt.

(3) The pair of rotational members 11 and 3 that is for fixing a toner image may be replaced with a pair of rotational members that is heated.

(4) It is not mandatory that the heating system for heating the rotational members 11 and 3 is the heating system based on electromagnetic induction. That is, the fixing apparatus 300 may be configured so that a halogen heater, an infrared lamp, a ceramic heater, or the like heating system can be employed in place of the heating system employed in the embodiments described above.

(5) The fixing apparatus 300 can be used as the image heating means. More concretely, it can be used as a glossing apparatus (also is referred to as fixing apparatus) for reheating the fixed image on a sheet P of recording medium to increase the image in glossiness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming station configured to form a toner image on a recording material;

a rotatable heating member and a rotatable pressing member that are configured to form a nip for fixing the toner image on the recording material;

a rotatable heat absorption member configured to absorb heat by contacting said rotatable pressing member;

a moving mechanism configured to move said rotatable heat absorption member to and away from said rotatable pressing member;

a detecting portion configured to detect an abnormal state in which said rotatable heat absorption member remains in contact with said rotatable pressing member; and a controller configured to control an interval between adjacent recording materials when an image forming operation is continuously carried out for a plurality of recording materials, wherein, when said detecting portion does not detect the abnormal state, said controller supplies the recording materials into the nip at a first feeding interval, and, when said detecting portion detects the abnormal state, said controller supplies the recording materials into the nip at a second feeding interval that is longer than the first interval.

2. The image forming apparatus according to claim 1, wherein, when said detecting portion detects the abnormal state, said controller supplies the recording material into the nip at the first feeding interval, after supplying the recording material into the nip at the second feeding interval is carried out for a predetermined period.

3. The image forming apparatus according to claim 2, wherein the predetermined period corresponds to reaching a predetermined number of recording materials on which the images are formed during the image forming operation.

4. The image forming apparatus according to claim 2, wherein the predetermined period corresponds to an operating time period for the image forming operation reaching a predetermined value.

5. The image forming apparatus according to claim 1, wherein the image forming operation is the operation for image formation on a maximum width recording material that is usable with said image forming apparatus.

6. An image forming apparatus comprising:

an image forming station configured to form a toner image on a recording material;

a rotatable heating member and a rotatable pressing member that are configured to form a nip for fixing the toner image on the recording material;

a rotatable heat absorption member configured to absorb heat by contacting said rotatable pressing member;

a moving mechanism configured to move said rotatable heat absorption member to and away from said rotatable pressing member;

a detecting portion configured to detect an abnormal state in which said rotatable heat absorption member is unable to contact said rotatable pressing member and remains spaced from said rotatable pressing member; and a controller configured to control an interval between adjacent recording materials when an image forming operation is continuously carried out for a plurality of predetermined recording materials that have widths smaller than a maximum width that is usable with said image forming apparatus, wherein, when said detecting portion detects the abnormal state, said controller supplies the recording materials into the nip at a first feeding interval, for a predetermined period, and thereafter, said controller supplies the recording materials into the nip at a second feeding interval that is longer than the first interval.

7. The image forming apparatus according to claim 6, wherein, when said detecting portion does not detect the abnormal state, said controller supplies the recording materials into the nip at the first feeding interval, until the number of recording materials for which the image forming operation is carried out reaches a predetermined number, and thereafter, said controller contacts said rotatable heat absorption member to said rotatable pressing member.

8. The image forming apparatus according to claim 6, further comprising a temperature sensor for detecting a temperature of an area at a longitudinal end portion of said rotatable heating member, wherein, when said detecting portion does not detect the abnormal state, said controller supplies the recording materials into the nip at the first interval until the temperature detected by said temperature sensor reaches a predetermined temperature, and thereafter, said controller contacts said rotatable heat absorption member to said rotatable pressing member.

* * * * *